US011255084B2

(12) United States Patent
Iverson

(10) Patent No.: US 11,255,084 B2
(45) Date of Patent: Feb. 22, 2022

(54) THERMAL BREAK WOOD COLUMNS, BUTTRESSES AND HEADERS WITH RIGID INSULATION

(71) Applicant: Roosevelt Energy, LLC, Ham Lake, MN (US)

(72) Inventor: Brian Iverson, Ham Lake, MN (US)

(73) Assignee: Roosevelt Energy, Inc., Ham Lake, MN (US)

( * ) Notice: Subject to any disclaimer, the term of this patent is extended or adjusted under 35 U.S.C. 154(b) by 0 days.

(21) Appl. No.: 16/897,090

(22) Filed: Jun. 9, 2020

(65) Prior Publication Data

US 2020/0385976 A1 Dec. 10, 2020

Related U.S. Application Data

(60) Provisional application No. 62/859,387, filed on Jun. 10, 2019.

(51) Int. Cl.

| | |
|---|---|
| ***E04B 1/26*** | (2006.01) |
| ***E04C 3/12*** | (2006.01) |
| ***E04C 3/36*** | (2006.01) |

(52) U.S. Cl.

CPC ..... *E04B 1/26* (2013.01); *E04C 3/127* (2013.01); *E04C 3/36* (2013.01)

(58) Field of Classification Search

CPC ..... E04C 3/12; E04C 3/14; E04C 3/16; E04C 3/122; E04C 3/127; E04C 3/29; E04C 3/291; E04C 3/36; E04B 1/26; E04B 2001/264

See application file for complete search history.

(56) References Cited

U.S. PATENT DOCUMENTS

| | | | |
|---|---|---|---|
| 4,224,774 | A | 9/1980 | Petersen |
| 4,329,827 | A | 5/1982 | Thorn |
| 4,578,909 | A | 4/1986 | Henley et al. |
| 4,578,914 | A | 4/1986 | Staples |
| 4,671,032 | A | 6/1987 | Reynolds |
| 4,720,948 | A | 1/1988 | Henley et al. |

(Continued)

FOREIGN PATENT DOCUMENTS

| | | | |
|---|---|---|---|
| EP | 1522644 A1 * | 4/2005 | ..... E04B 2/7457 |
| EP | 1705305 | 9/2006 | |

(Continued)

OTHER PUBLICATIONS

Betzwood Associated PC, "5 Proven Ways to Optimize Framing," http://www.betzwood.com/2012/08/09/optimize-framing/, pp. 1-7.

(Continued)

*Primary Examiner* — Christine T Cajilig
(74) *Attorney, Agent, or Firm* — Taft Stettinius & Hollister LLP; Gerald E. Helget

(57) ABSTRACT

A thermal break wood and rigid insulation wall support column, buttress or header is comprised of spaced apart multiple parallel and right angled wood panels. The right angled wood panels are secured together by box joints. Non-metallic angled mechanical fasteners hold the lumber panels together in a truss angled arrangement maintaining the panels spaced relationship. A thermal break section of rigid foam insulation is injected between the lumber panels and around the mechanical fasteners.

15 Claims, 15 Drawing Sheets

(56) References Cited

U.S. PATENT DOCUMENTS

| | | | | |
|---|---|---|---|---|
| 4,741,144 | A * | 5/1988 | Graffin | E04C 3/127 52/423 |
| 4,765,105 | A * | 8/1988 | Tissington | E04C 2/288 264/46.5 |
| 4,852,310 | A | 8/1989 | Henley et al. | |
| 4,852,322 | A | 8/1989 | McDermid | |
| 4,937,122 | A | 6/1990 | Talbert | |
| 5,209,036 | A | 5/1993 | Cancilliari | |
| 5,609,006 | A | 3/1997 | Boyer | |
| 5,617,693 | A | 4/1997 | Hefner | |
| 5,720,144 | A | 2/1998 | Knudson et al. | |
| RE36,153 | E * | 3/1999 | Sing | E04C 3/29 52/309.9 |
| 6,125,608 | A | 10/2000 | Charlson | |
| 6,519,912 | B1 * | 2/2003 | Eckmann | B27M 3/0053 52/589.1 |
| 7,574,837 | B2 | 8/2009 | Hagen, Jr. et al. | |
| 7,743,578 | B2 | 6/2010 | Edmondson | |
| 7,866,112 | B2 | 1/2011 | Edmondson | |
| 8,424,266 | B2 | 4/2013 | Edmondson | |
| 8,516,778 | B1 | 8/2013 | Wilkens | |
| 8,793,948 | B2 | 8/2014 | Beattie | |
| 8,820,034 | B1 | 9/2014 | Watts et al. | |
| 9,103,113 | B2 | 8/2015 | Lockhart | |
| 9,604,428 | B2 | 3/2017 | Walker | |
| 9,677,264 | B2 | 6/2017 | Iverson | |
| 9,783,985 | B2 * | 10/2017 | Iverson | E04B 2/707 |
| 2005/0050847 | A1 | 3/2005 | Lott | |
| 2005/0183367 | A1 | 8/2005 | Lembo | |
| 2006/0236652 | A1 | 10/2006 | Kismarton | |
| 2006/0254197 | A1 | 11/2006 | Tiberi et al. | |
| 2007/0130866 | A1 | 6/2007 | Lott | |
| 2007/0227095 | A1 | 10/2007 | Hubbe | |
| 2007/0283661 | A1 | 12/2007 | Daniels | |
| 2008/0245030 | A1 | 10/2008 | Sieber | |
| 2009/0044486 | A1 * | 2/2009 | Kimura | E04C 3/14 52/831 |
| 2010/0037542 | A1 | 2/2010 | Tiberi et al. | |
| 2010/0236172 | A1 * | 9/2010 | Wirth | E04B 1/26 52/309.4 |
| 2010/0300037 | A1 | 12/2010 | Turner et al. | |
| 2011/0107693 | A1 | 5/2011 | Haskell | |
| 2011/0239573 | A1 * | 10/2011 | Lockhart | E04B 2/7412 52/404.1 |
| 2012/0011793 | A1 | 1/2012 | Clark et al. | |
| 2016/0289968 | A1 | 10/2016 | De Waal | |
| 2016/0356044 | A1 | 12/2016 | Thompson | |
| 2020/0080297 | A1 * | 3/2020 | Wright | E04B 1/14 |

FOREIGN PATENT DOCUMENTS

| | | | | |
|---|---|---|---|---|
| EP | 3453809 | A1 * | 3/2019 | E04C 2/40 |
| RU | 86608 | U1 | 9/2009 | |
| WO | WO-2011018758 | A1 * | 2/2011 | E04H 12/06 |
| WO | 2014197972 | | 12/2014 | |
| WO | 2017011121 | | 1/2017 | |

OTHER PUBLICATIONS

International Search Report and Written Opinion of PCT/US2016/037357, dated Sep. 8, 2016.

Extended European Search Report for Application No. 16824858.1, dated Apr. 1, 2019, 9 pages.

* cited by examiner

SQUARE CORNER SECTIONS

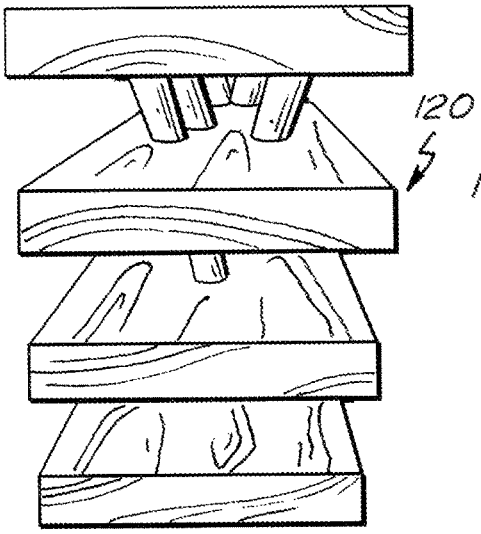
Fig.26
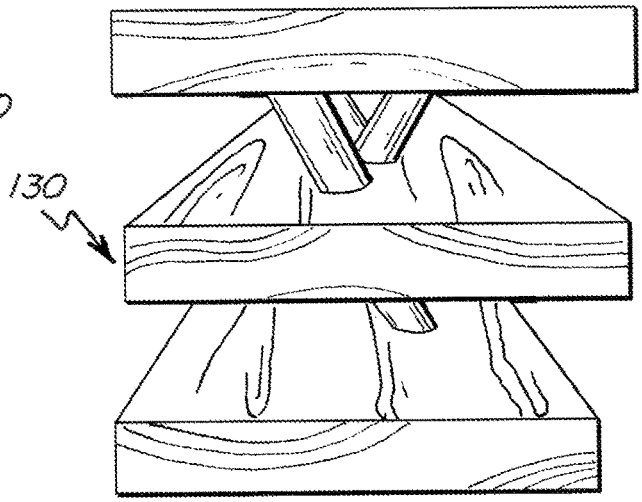
Fig.27
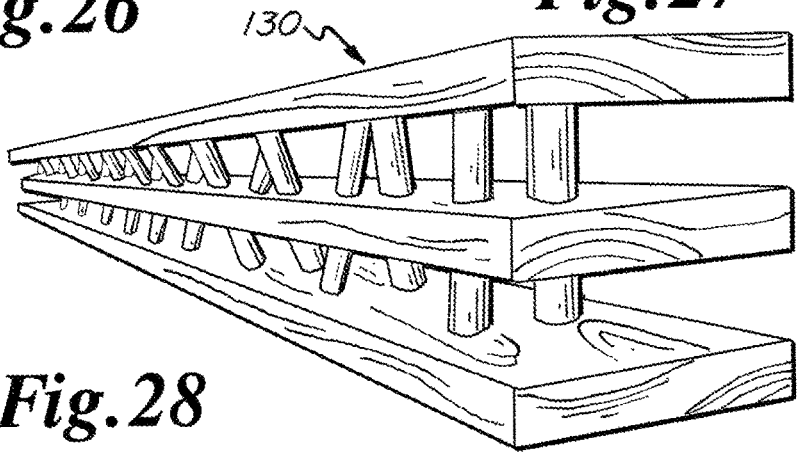
Fig.28
Fig.29
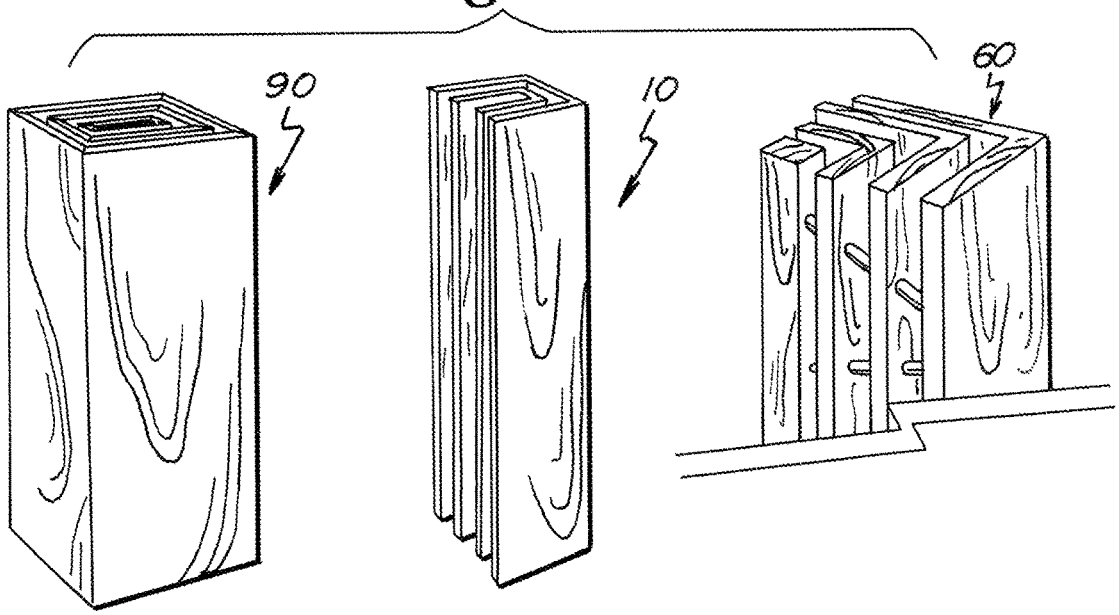

THERMAL BREAK WOOD COLUMNS, BUTTRESSES AND HEADERS WITH RIGID INSULATION

BACKGROUND OF THE INVENTION

The present invention relates to wood framing systems for tall commercial and tenant buildings that may go upwards to and over twenty-five stories that are all made from wood without steel or concrete. More specifically, the present invention is concerned with vertical wall column, buttress and header framing systems and component designs with built-in thermal breaks. These systems and designs deal with and solve the load problems with tall buildings, while yet being all made with wood, and with no use of steel or concrete.

Standard residential and small commercial construction today uses either 2×4 or 2×6 solid lumber generally spaced 16" on center. Where energy conservation is a concern, most builders frame an exterior wall with 2×6's. Up to 30 percent of the exterior wall (studs, top and bottom plates, cripple studs, window/door jams and headers) is solid wood framing. Thermal bridges are points in the wall that allow heat and cold conduction to occur. Heat and cold follow the path of least resistance—through thermals bridges of solid wood across a temperature differential wherein the heat or cold is not interrupted by thermal insulation. The more volume of solid wood in a wall also reduces available insulation space, and further, the thermal efficiency of the wall suffers and the R value (resistance to conductive heat flow) decreases. These problems were solved by Applicant's previous two issued U.S. Pat. Nos. 9,677,264 and 9,783,985 for thermal break wood studs (Tstuds®), both incorporated by reference here.

Commercial building structures in excess of five stories, and up to twenty-five stories, require phenomenally more vertical support and bending resistance beyond the capacity of Applicant's patented thermal break wood stud with rigid insulation with non-metal fasteners and wall framing system. Also, commercial building structures materials are beyond the capacity of convention lumber (2×2, 2×4, 2×6, 2×12, 4×4, 6×6 12×12, etc.). Traditionally these structures are made with steel and concrete floors, walls, ceilings and vertical support columns and headers. While structures made with these materials are adequate for vertical support and bending resistance, they are extremely expensive to build and do not adequately deal with heat and air conditioning losses to the environment through exterior walls. Steel and concrete structural materials deplete natural resources, are harsh on the environment in their manufacture and also pose significant problems when it is time to demolish and recycle these structural materials.

SUMMARY OF THE INVENTION

A thermal break wood and rigid insulation wall support column, buttress or header is comprised of spaced apart multiple parallel and right angled wood panels. The right angled wood panels are secured together by box joints. Non-metallic angled mechanical fasteners hold the lumber panels together in a truss angled arrangement maintaining the panels spaced relationship. A thermal break section of rigid foam insulation is injected between the lumber panels and around the mechanical fasteners.

A principal object and advantage of the present invention is that there is percentage increase in exterior wall construction energy efficiency.

Another principal object and advantage of the present invention is that the present invention would save considerable expense in not using concrete and steel which could cost twice as much.

Another principal object and advantage of the present invention is that using wood columns, which are a natural and renewable sourced material, would eliminate the manufacture, reclamation and recycling of waste or demolished steel and concrete.

Another principal object and advantage of the present invention is that the invention has a smaller carbon footprint than standard commercial building construction simply by use of less materials and labor costs.

Another principal object and advantage of the present invention is that there is more insulation in the column cavities with less solid wood to increase thermal efficiency (R value) as compared to R values of concrete, steel and conventional wood as noted below:

TABLE 1

| Average R Value for Concrete | Thickness | R Value | Polyiso foam | Wood | Steel |
|---|---|---|---|---|---|
| Concrete 60 pounds density per cubic foot | 1" | 0.52 | 6.67 | 1.25 | 0.0031 |
| Concrete 70 pounds density per cubic foot | 1" | 0.42 | 6.67 | 1.25 | 0.0031 |
| Concrete 80 pounds density per cubic foot | 1" | 0.33 | 6.67 | 1.25 | 0.0031 |
| Concrete 90 pounds density per cubic foot | 1" | 0.26 | 6.67 | 1.25 | 0.0031 |
| Concrete 100 pounds density per cubic foot | 1" | 0.21 | 6.67 | 1.25 | 0.0031 |
| Concrete 120 pounds density per cubic foot | 1" | 0.13 | 6.67 | 1.25 | 0.0031 |
| Concrete 150 pounds density per cubic foot | 1" | 0.07 | 6.67 | 1.25 | 0.0031 |

The more weight of a concrete column is able to hold, the higher the density

Another principal object and advantage of the present invention is that the windows and doors have a thermal break all around the window and door openings thus improving the thermal effectiveness of the window and door jams.

Another principal object and advantage of the present invention is that there could be a reduction in the needed and required sizing for HVAC, furnaces and air conditioning equipment.

Another principal object and advantage of the present invention is that the column designs and framing systems requires less labor time (carpenters only) to rough-in a building simply because the vertical strength of the columns will support commercial buildings with only wood up to and beyond twenty-five stories without the need of cement and steel workers.

Another principal object and advantage of the present invention is that all these objects and advantages are accomplished without losing any integrity in building performance or structural qualities.

Another principal object and advantage of the present invention is that there will be a reduction on the future utility grid and a reduction on the future carbon footprint required to produce the electricity and gas to heat and cool a commercial building built to according to this invention.

Another principal object and advantage of the present invention is the fire rating of the thermal break wood columns is significant by having a Class A fire rating versus typical construction 2× wood members of having a Class C fire rating, thus potentially saving lives, allowing fire personnel to enter a burning structure more often and allowing additional time for occupants to vacate a burning structure.

BRIEF DESCRIPTION OF THE DRAWINGS

FIG. 26 is an end perspective view of a quad parallel-shaped thermal break wood support column with mechanical fasteners;

FIG. 27 are end perspective view of a triple parallel-shaped thermal break wood support column with mechanical fasteners;

FIG. 28 is a side perspective view of a triple parallel-shaped thermal break wood support column with mechanical fasteners;

FIG. 29 is a front perspective view of square-shaped, U-shaped and L-shaped thermal break wood support columns with mechanical fasteners;

DETAILED SPECIFICATION

Figure 1:
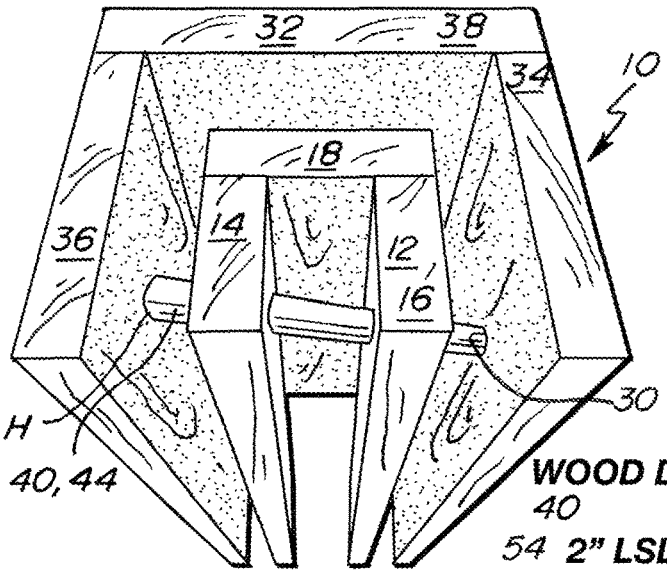
FIG. 1 is a top front perspective view of a double U-shaped thermal break wood support column with mechanical fasteners.
Figure 1A:
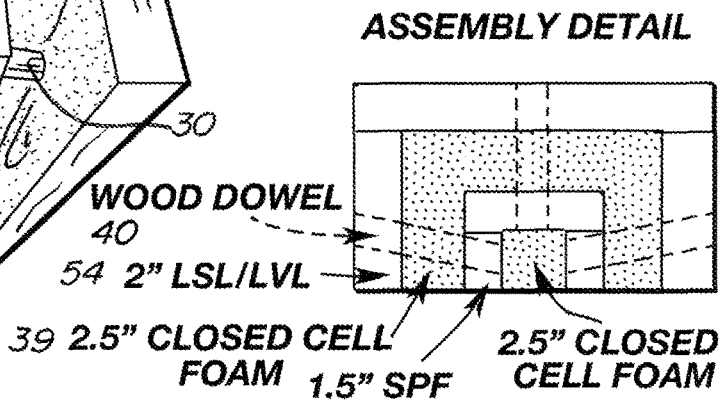
FIG. 1A is a top plan assembly view of the double U-shaped thermal break wood support column with mechanical fasteners showing placement of the closed cell foam of FIG. 1.

Referring to FIGS. 1-7, the double U-shaped design of the thermal break wood support column (or header) 10 with mechanical fasteners 40 of the invention may be seen and is generally used as an exterior or interior wall support buttress, header or column 10. The double U design (double half box) 10 comprises an inner U section 12 that has two side panels 14 and 16 and a rear panel 18. The panels are held together by an overlapping tab and cut out (box joint) 28 that are fastened together suitably with glue 30 illustrated in FIGS. 5A. 5B and 5C. The double U design 10 also comprises an outer U section 32 that has two side panels 34 and 36 and a rear panel 38. The panels 14, 16, 18, 34, 36 and 38 are held together by an overlapping tab and cut out (box joint) 28 arrangement that are secured together suitably with glue 30 illustrated in FIGS. 5A. 5B and 5C. Suitable wood glues 30 might be polymethylene polyphenyl isocyanate or penta-NA diethylenetriamine pentaacetate obtainable from Ashland of Columbus, Ohio sold under the trademark ISO-SET™ or a two part acrylic-based emulsion polymer isocyanate so under the trademark ADVANTAGE EP-950 ATM by Franklin International of 2020 Bruck Street, Columbus, Ohio 43207 USA.

One can size and place tabs and cut outs 28 so support column 10 has only one way to be put together as all square reference surfaces are built-in. Thus, this two dimensional all edge-face assembly is fool proof and easy to form and assemble.

Wood is defined as any wood or lumber product and any wood derivative composite product. Whereby the definition of "wood derivative" is defined as a "New product that results from modifying an existing product, and which has different properties than those of the product it is derived from." Lumber, timber, wood, or wood derivative, includes any and all structural composite lumber products, such as laminated strand lumber (LSL). This would also include structural composite lumber (SCL), which includes laminated veneer lumber (LVL), parallel strand lumber (PSL), laminated strand lumber (LSL), oriented strand lumber (OSL) and cross-laminated lumber (CTL). Nanocellulose materials, such as cellulose nanocrystals (CNC), would be included in this group. These composite lumbers are of a family of engineered wood products created by layering dried and graded wood veneers, strands or flakes with moisture resistant adhesive into blocks of material known as billets, which are subsequently re-sawn into specified sizes. In SCL billets, the grain of each layer of veneer or flakes runs primarily in the same direction. The resulting products out-perform conventional lumber when either face or edge-loaded. SCL is a solid, highly predictable, and uniform engineered wood product that is sawn to consistent sizes and is virtually free from warping and splitting.

Figure 6:
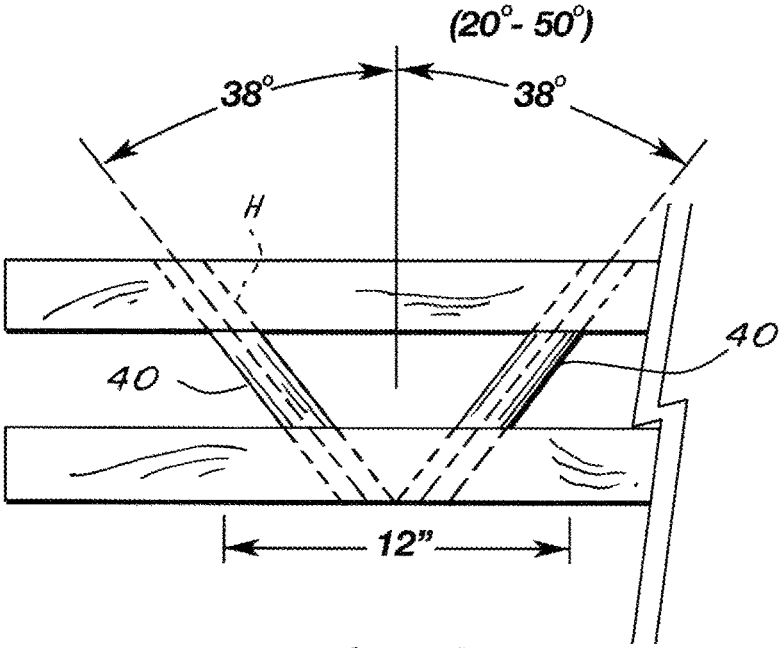
FIG. 6 is a broken away side elevational view of the longitudinal angularity of the mechanical fasteners.
Figure 7:
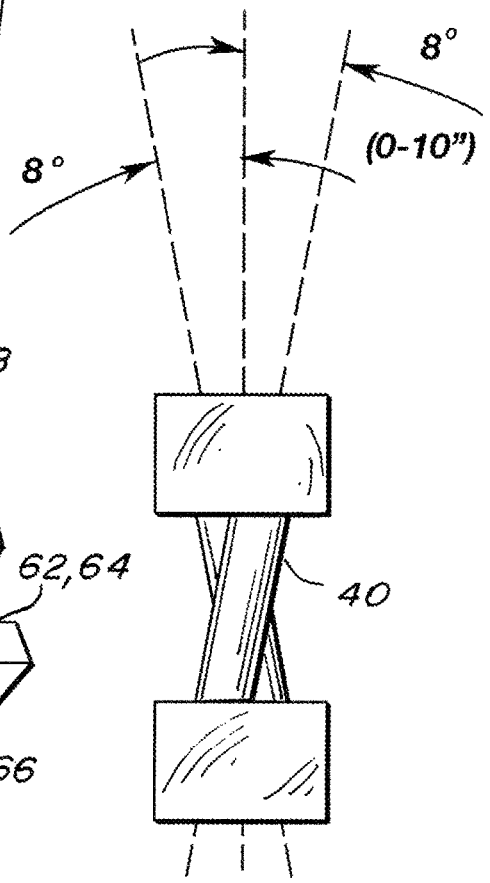
FIG. 7 is a end elevational view of the width angularity of the mechanical fasteners.
Figure 8:
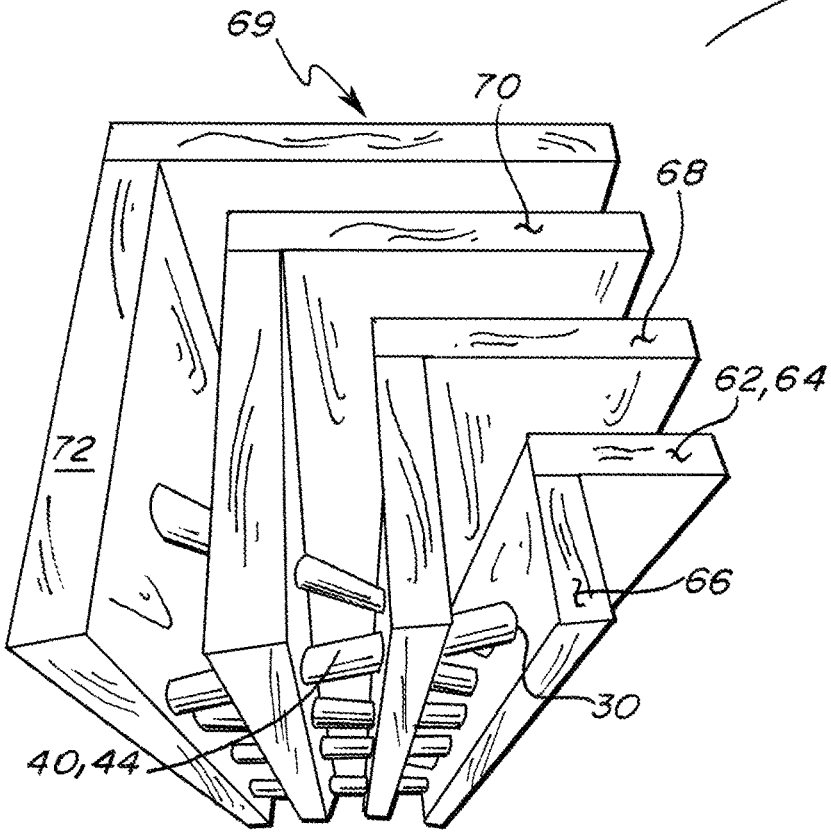
FIG. 8 is a top perspective view of the a quad 90° or L-shaped thermal break wood support column with mechanical fasteners (used as a corner column) looking down into its inerior.
Figures 8A, 8B, 8C:
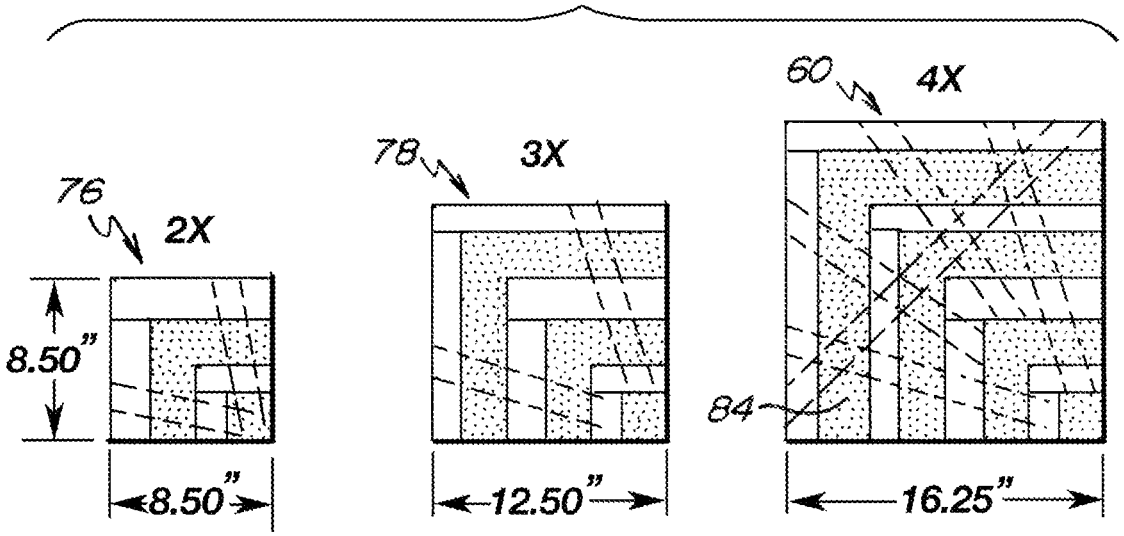
FIG. 8A is a top plan dimensional assembly view of a double 90° L-shaped thermal break wood support column with mechanical fasteners showing placement of the closed cell foam.
FIG. 8B is a top plan dimensional assembly view with outer dimensions of a triple 90° L-shaped thermal break wood support column with mechanical fasteners showing placement of the closed cell foam.
FIG. 8C is a top plan dimensional assembly of a quad 90° L-shaped thermal break wood support column with mechanical fasteners showing placement of the closed cell foam.
Figures 8D, 8E:
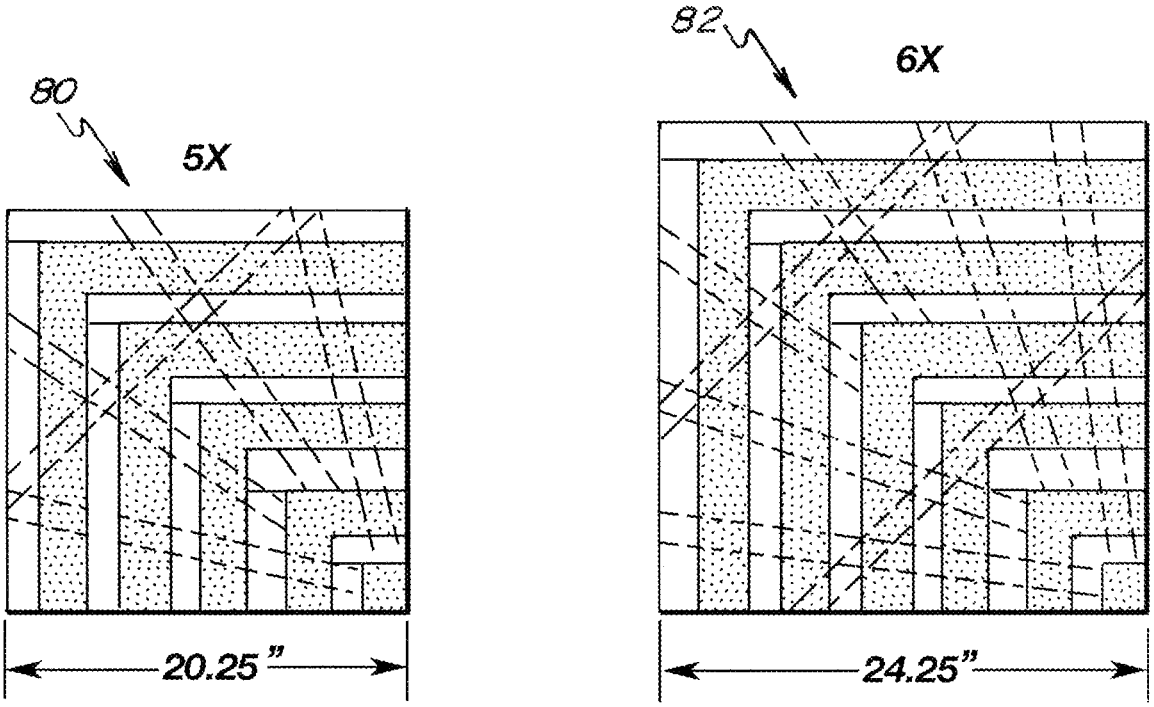
FIG. 8D is a top plan dimensional assembly view a six 90° L-shaped thermal break wood support column with mechanical fasteners showing placement of the closed cell foam.
FIG. 8E is a top plan dimensional assembly view a five 90° L-shaped thermal break wood support column with mechanical fasteners showing placement of the closed cell foam.

Mechanical fasters 40 are suitably hard wood dowels 40 approximately 11/16-1½ " in diameter to match holes H through the panels 14, 16, 18, 34, 36 and 38. The dowels 40 are run through an abrader device to create a helical outer grooved or fluted outer surface 44 which aids in retaining glue 30 on the outer surface 44 of dowels 40. Panels 14, 16, 18, 34, 36 and 38 suitably have angled holes H drilled through them as shown in FIGS. 6 and 7. The holes H in the longitudinal direction have an angles that range from 20°-50° (preferably 38°) and 0°-10° (preferably 8°) in the width direction. Next, wood glue 30 is suitably then coated on the inside surfaces of the angled holes H. The dowels 40 are then pounded into and through holes H after which sawing, sanding or grinding will make the dowels 40 flush with the outer wood panels 34, 36 and 38. Mechanical fasteners 40 may also be made of heat resistant plastic. The important consideration is that the dowel 40 must have a high modulus of elasticity. When using parallel panels 14, 16, 18, 34, 36 and 38, two of the mechanical fasteners or dowels 40 are used per foot of column 20. When using 90° angled panels, discussed below, four staggered and angled mechanical fasteners 40 are used per foot of column 10.

Figure 1B:
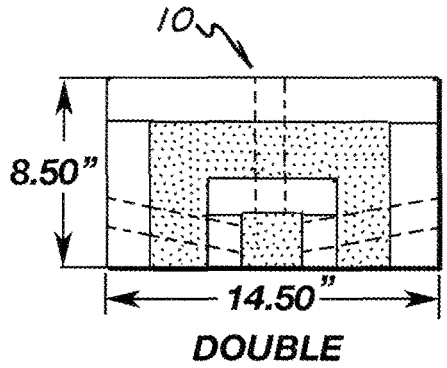
FIG. 1B is a top plan view with outer dimensions of the double U-shaped thermal break wood support column with mechanical fasteners showing placement of the closed cell foam of FIG. 1.
Figure 1C:
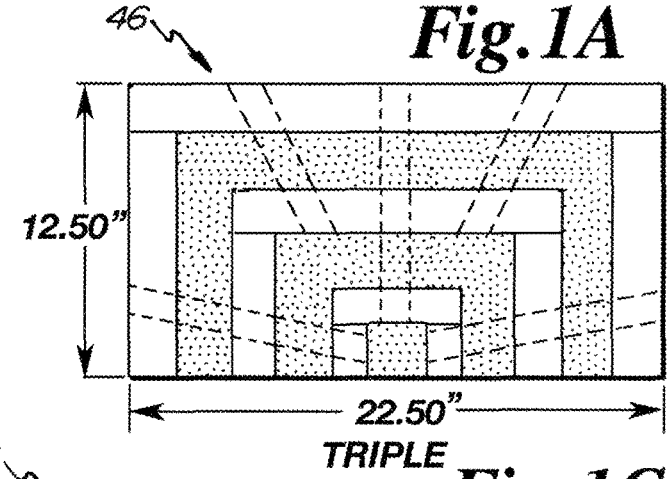
FIG. 1C is a top plan assembly view with outer dimensions of the triple U-shaped thermal break wood support column with mechanical fasteners showing placement of the closed cell foam.
Figure 1D:
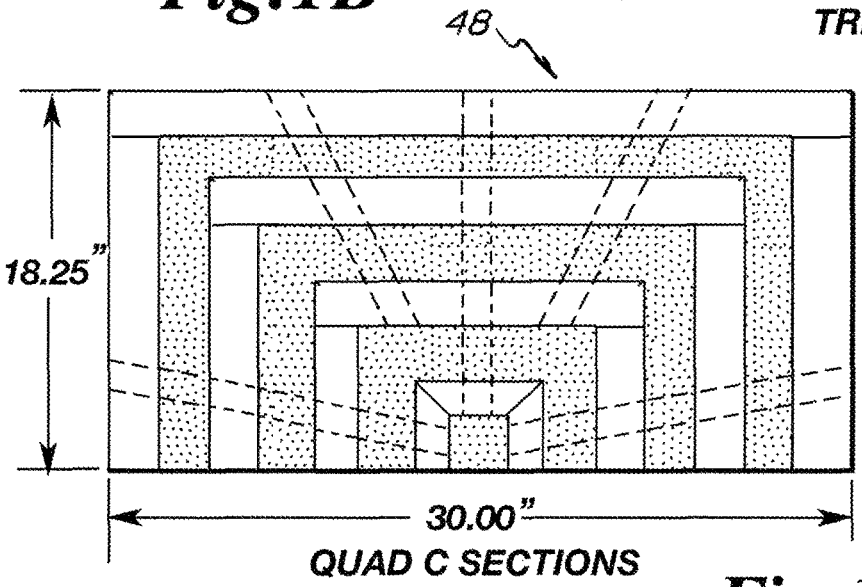
FIG. 1D is a top plan assembly view with outer dimensions of the quad U-shaped thermal break wood support column with mechanical fasteners showing placement of the closed cell foam.
Figure 2:
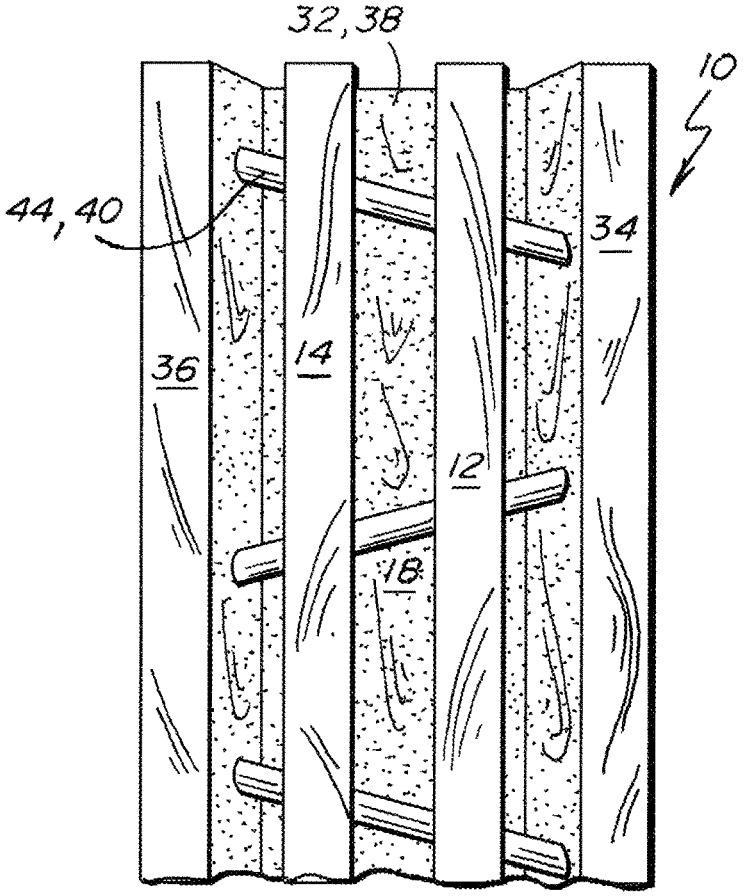
FIG. 2 is a front elevational view of the double U-shaped thermal break wood support column with mechanical fasteners of FIG. 1.
Figure 3:
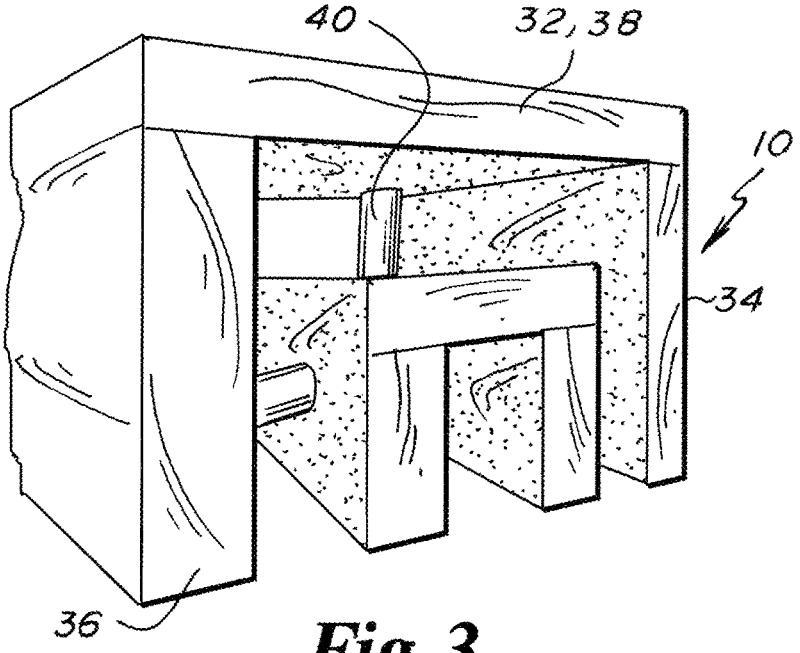
FIG. 3 is a top side perspective view of the double U-shaped thermal break wood support column with mechanical fasteners of FIG. 1.
Figure 4:
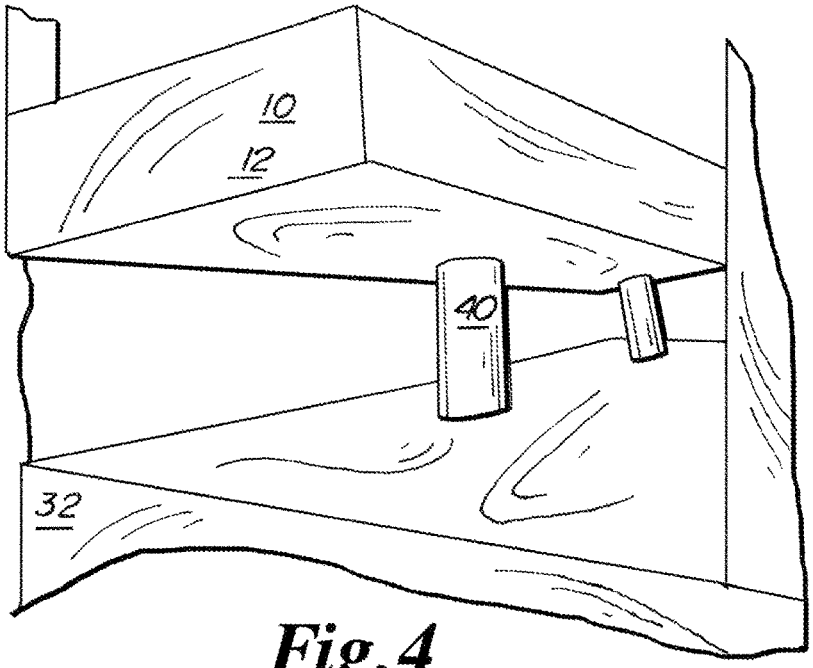
FIG. 4 is a top perspective view of the double U-shaped thermal break wood support column with mechanical fasteners of FIG. 1 looking down into its interior.
Figure 5A:
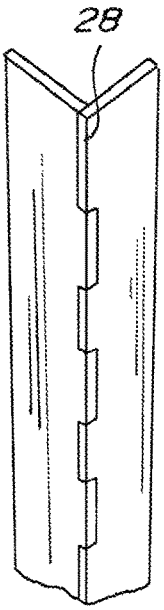
FIGS. 5A, 5B and 5C are a front perspective views of the box joint structures that connect the 90° wood panels.
Figure 5B:
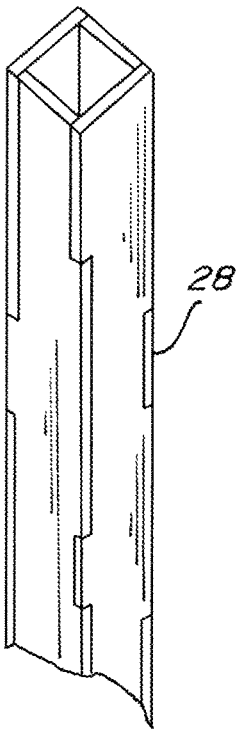
Figure 5C:
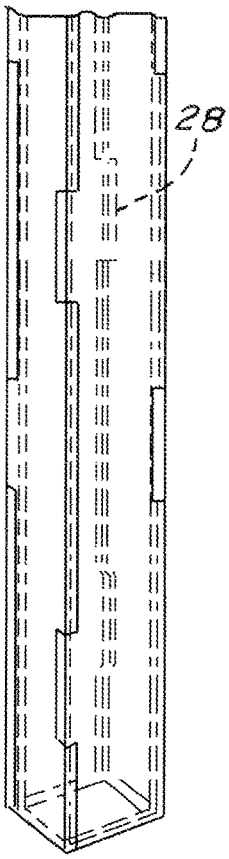

Next the assembled wood column 10 is coated with a liquid wood protection system that is warranted for fire (class A), mould, rot, and insect infestation, including termites. The wood protection system can be applied to the wood column 10 in the following manners: spray booth, flood coater, dip tank, sprayer, brush, roller or pressure treatment. Such a wood protection system is sold under the trademark NEXGEN ADVANCED™ by NexGen ECOatings, Inc. of Vancouver, BC, Canada This double U wall wood column design 10 may be built, as shown to be a double U design 10, to be a triple 46, quad 48, five 50 or six 52 wall U Shape design, illustratively shown in FIGS. 1B, 1C and 1D. These designs are structurally desirable from 10' to as high as 40' tall with little to no deflection. This design will easily hold 25,000 lbs. Additional larger sizes should be anticipated.

The final foam section 39 may be of expanded polyurethane, polystyrene or polyisocyanurate. The foam 39 is injected into the open spaces around the mechanical fasteners 40 and between the wood panel sections 34, 36 and 38. The foam 39 may suitably made by mixing an isocyanate, such as methylene diphenyl diisocyanate (MDI) with a polyol blend, or other suitable rigid foam sheet or there equivalent. Such foams are sold under the trademark AUTOFROTH® sold by BASF Corporation of 100 Park Avenue Florham Park, N.J. 07932 USA and under the trademark PROTECH™ by Carpenter Co. of 5016 Monument Ave. Richmond, Va. 23230 USA In fact, it is to be anticipated that rigid foams of yet even high R values are on the market now with more being created that are and will be suitable for use with the present invention. Polyurethane insulation has the highest thermal resistance (R-values) at a given thickness and lowest thermal conductivity.

The following Table 2 shows R values and vertical compression strength ($F_c$) of the double U-shaped (double half box) 10, triple U-shaped design (triple half box) 46 and the quad U-shaped (quad half box) 48 wherein the loads are supported on the ends of the pieces:

TABLE 2

Compression Parallel to Grain Fc and Average R Value

| Type of Wood Member | PSI | Depth in inches | Double Half Box Tmax* | Ultimate Load in Pounds* | Average R Value | Triple Half Box Tmax* | Ultimate Load in Pounds* | Average R Value | Quad Half Box Tmax* | Ultimate Load in Pounds* | Average R Value |
|---|---|---|---|---|---|---|---|---|---|---|---|
| SPF | 1,150 | 1.5 | 40 | 69,000 | 30 | 84 | 144,900 | 40 | 144 | 248,400 | 50 |
| HemFir | 1,450 | 1.5 | 40 | 87,000 | 30 | 84 | 182,700 | 40 | 144 | 313,200 | 50 |
| DougFir | 1,400 | 1.5 | 40 | 84,000 | 30 | 84 | 176,400 | 40 | 144 | 302,400 | 50 |
| SYP #2 | 1,300 | 1.5 | 40 | 78,000 | 30 | 84 | 163,800 | 40 | 144 | 280,800 | 50 |
| MSR2100 | 1,825 | 1.5 | 40 | 109,500 | 30 | 84 | 229,950 | 40 | 144 | 394,200 | 50 |
| LSL | 2,600 | 2 | 40 | 208,000 | 30 | 84 | 436,800 | 40 | 144 | 748,800 | 50 |
| LVL | 3,571 | 2 | 40 | 285,680 | 30 | 84 | 599,928 | 40 | 144 | 1,028,448 | 50 |

*Total lineal inches of wood fiber

**Based on known paralell to grain axial loading based on Fc (SPF = spruce, pine fur; HemFir = hemlock fir; DougFir = Douglas fir; SYP #2 = southern yellow pine #2; MSR 2100 = machine stress rated to 2100 psi in bending; LSL = laminated strand lumber; LVL = laminated veneer lumber)

Referring next to FIGS. 8-17, the quad-shaped 90° or L shaped design of the thermal break wood support column (or header) 60 with mechanical fasteners 40 of the invention may be seen and is generally used as an exterior or interior corner wall support column 10. The quad L design 60 (corner) comprises an inner smallest section 62 that has two side panels 64 and 66. The panels are held together by an overlapping tab and cut out (box joint) 28 that are fastened together suitably with glue 30 illustrated in FIGS. 5A. 5B and 5C. Increasing size are second L section 68, third L section 70 and fourth largest L section 72 and similarly made panels.

Figure 9:
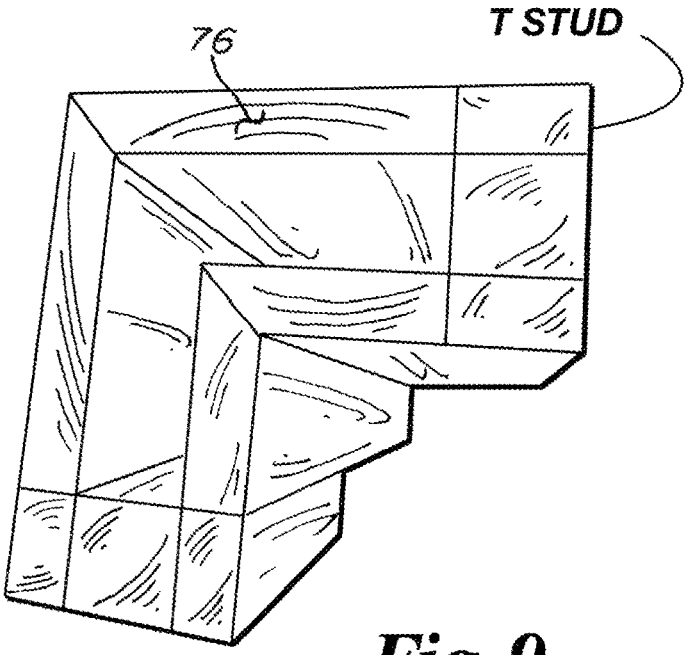
FIG. 9 is top plan view of a double 90° L-shaped thermal break wood support column with mechanical fasteners showing placement as a corner with adjoining thermal break wood studs of Applicant's previous two issued U.S. Pat. Nos. 9,677,264 and 9,783,985.
Figure 10:
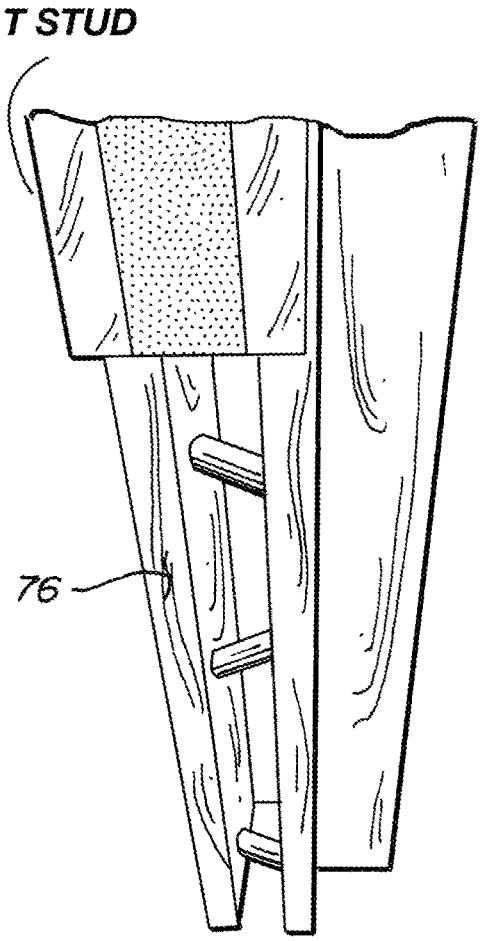
FIG. 10 is partial front elevational view of a double 90° L-shaped thermal break wood support column with mechanical fasteners showing placement as a corner with adjoining thermal break wood stud of Applicant's previous two issued U.S. Pat. Nos. 9,677,264 and 9,783,985 shown in the interior background.
Figure 11:
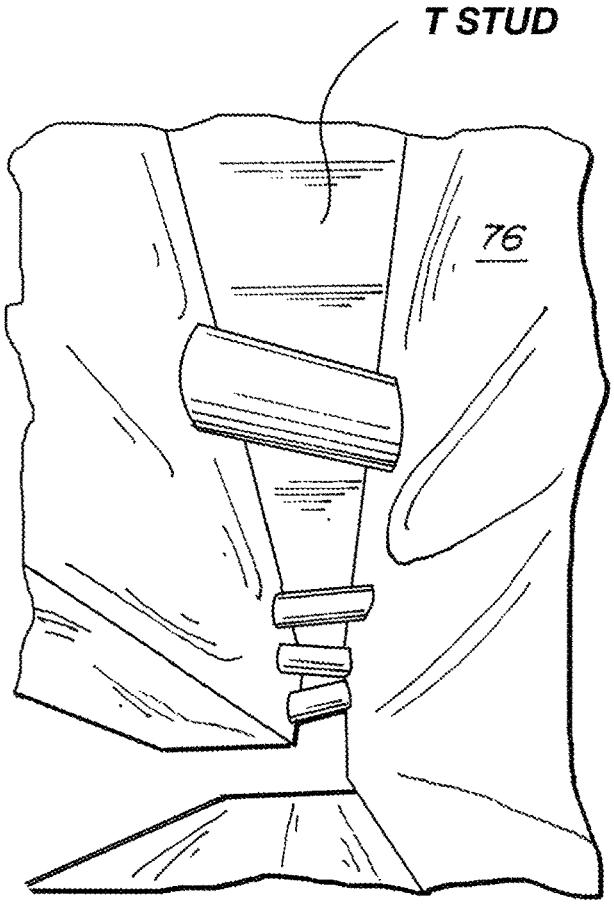
FIG. 11 is an enlarged partial front elevational view of a double 90° L-shaped thermal break wood support column with mechanical fasteners showing placement as a corner with adjoining thermal break wood stud of Applicant's previous two issued U.S. Pat. Nos. 9,677,264 and 9,783,985 shown in the interior background.
Figure 12:
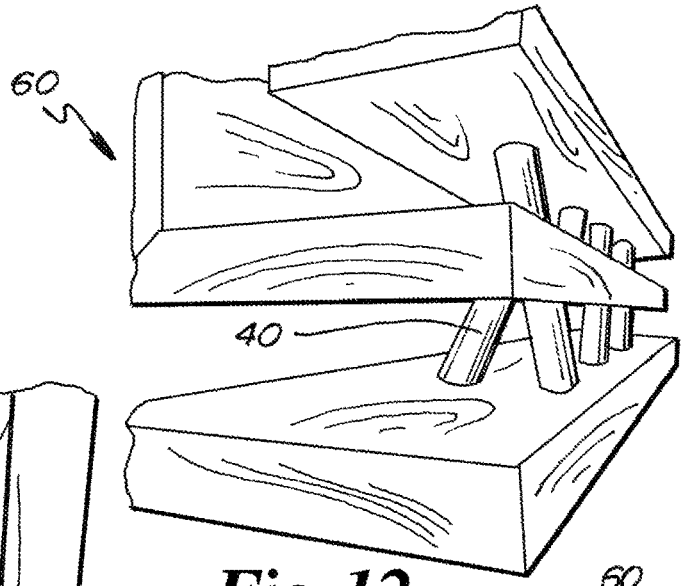
FIG. 12 is a top perspective view of a quad 90° L-shaped thermal break wood support column with mechanical fasteners looking down into its interior.
Figure 15:
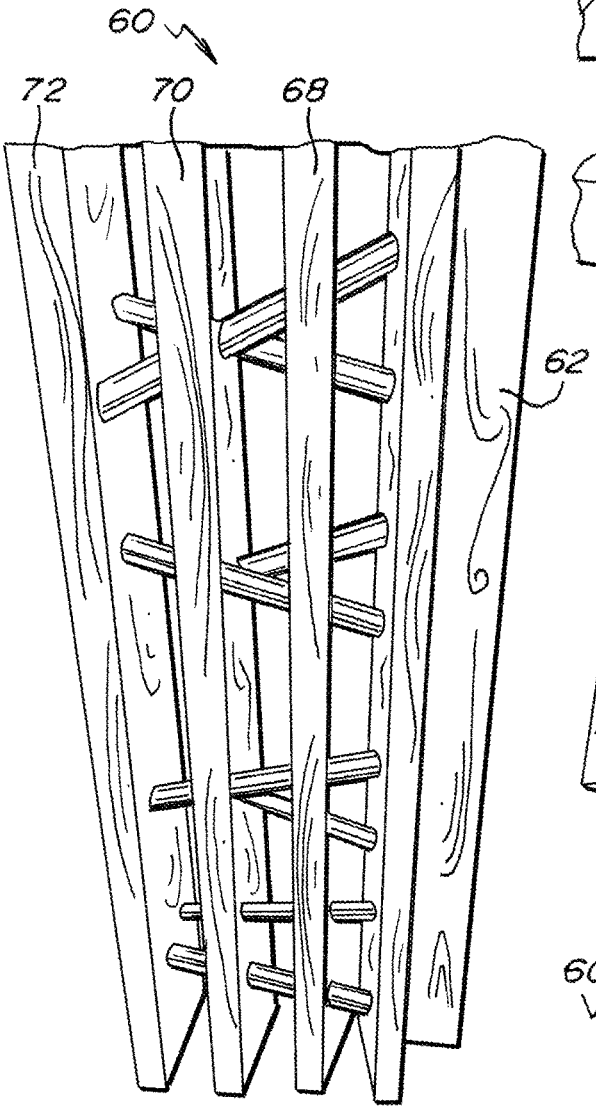
FIG. 15 is a side elevational view of the quad 90° L-shaped thermal break wood support column with mechanical fasteners.
Figure 13:
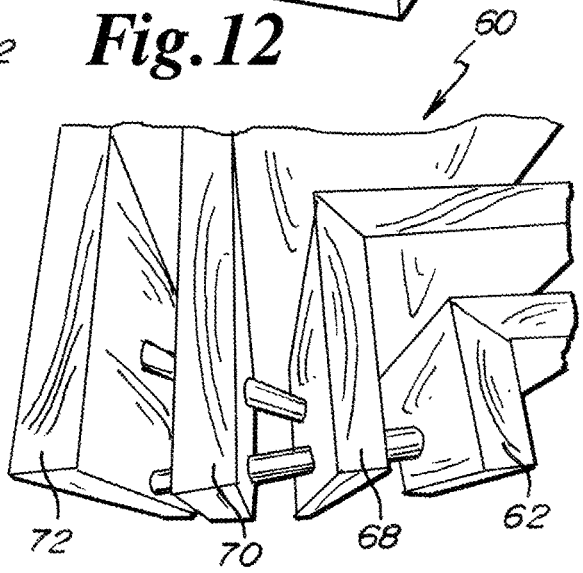
FIG. 13 is another top perspective view of the quad 90° L-shaped thermal break wood support column with mechanical fasteners looking down into its interior.
Figure 14:
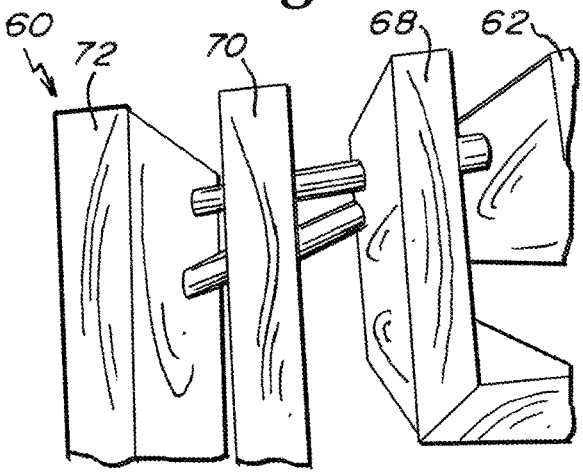
FIG. 14 is another top perspective view of the quad 90° L-shaped thermal break wood support column with mechanical fasteners looking down into its interior.
Figure 16:
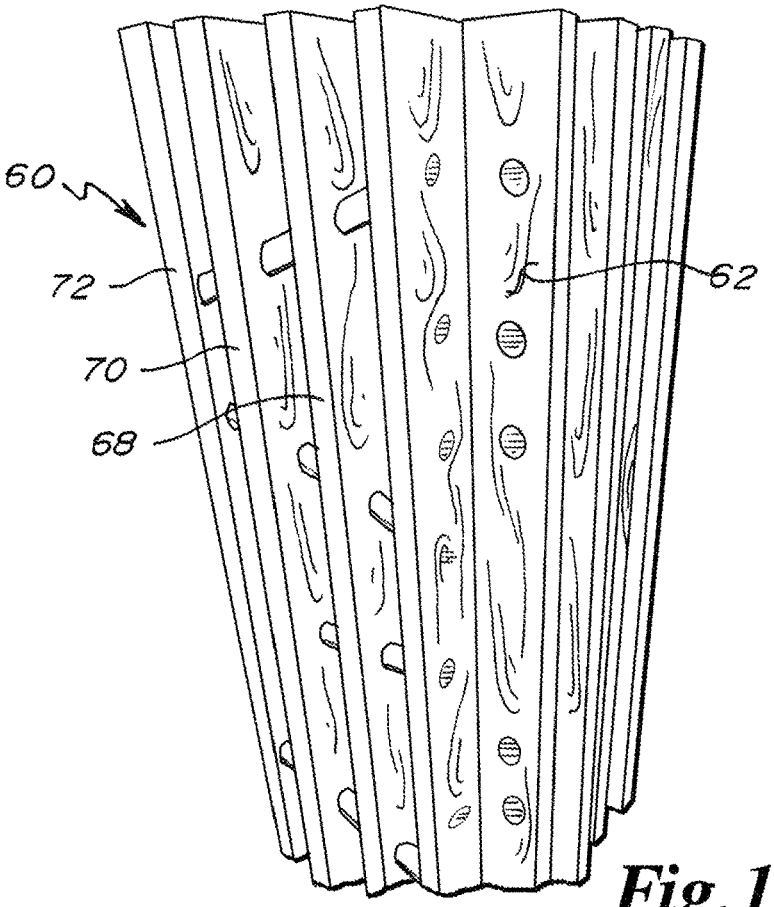
FIG. 16 is a front elevational view of the quad 90° L-shaped thermal break wood support column with mechanical fasteners.
Figure 17:
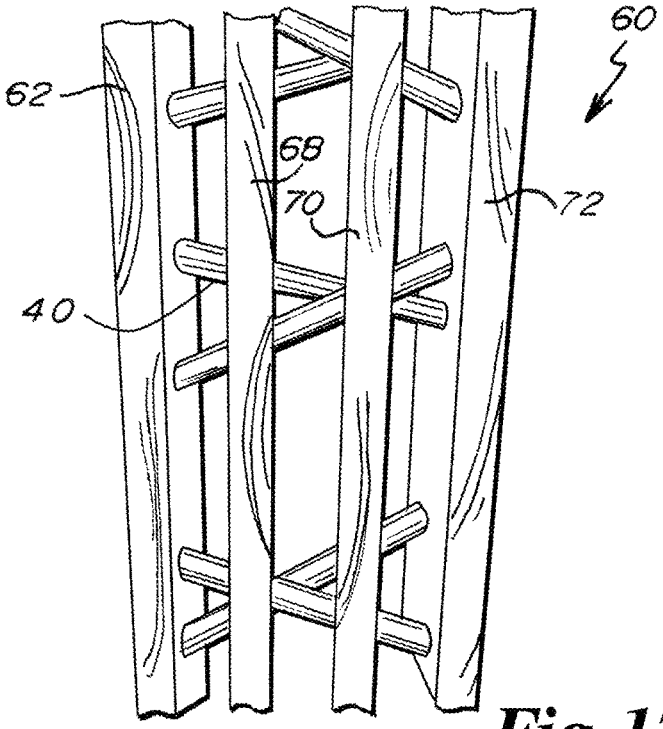
FIG. 17 is another side elevational view of the quad 90° L-shaped thermal break wood support column with mechanical fasteners.
Figure 18:
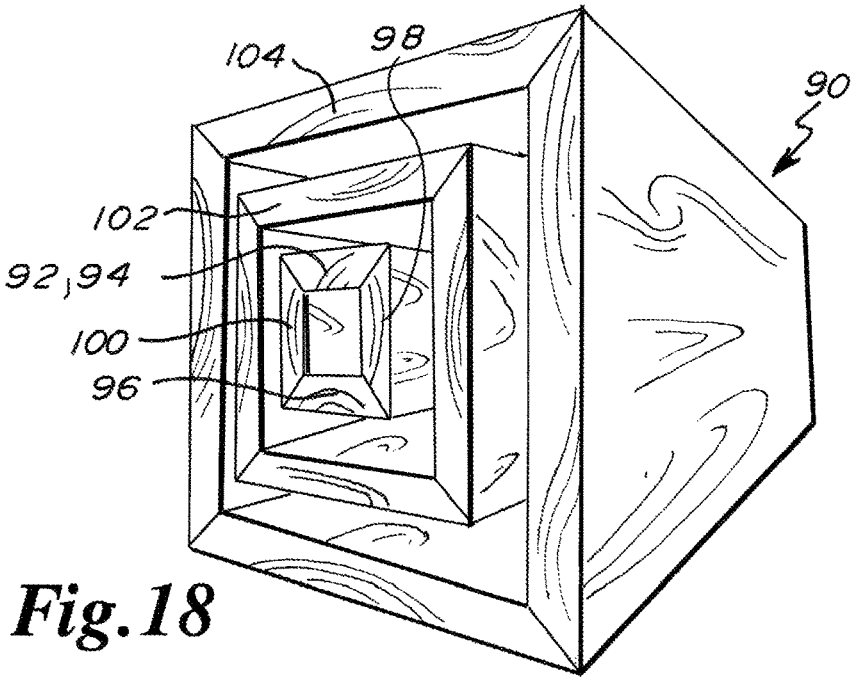
FIG. 18 is a top perspective view of a triple square or box-shaped thermal break wood support column with mechanical fasteners.
Figure 18A:
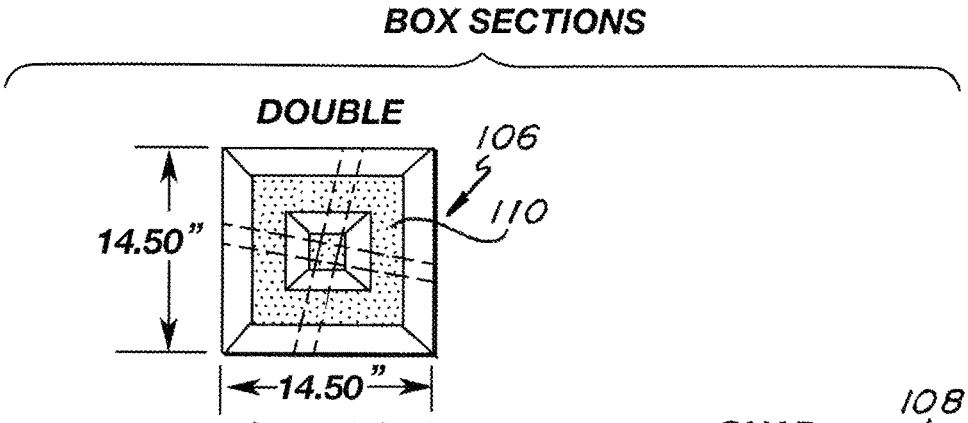
FIG. 18A is a top plan dimensional assembly view of a double square-shaped thermal break wood support column with mechanical fasteners showing placement of the closed cell foam.
Figure 18B:
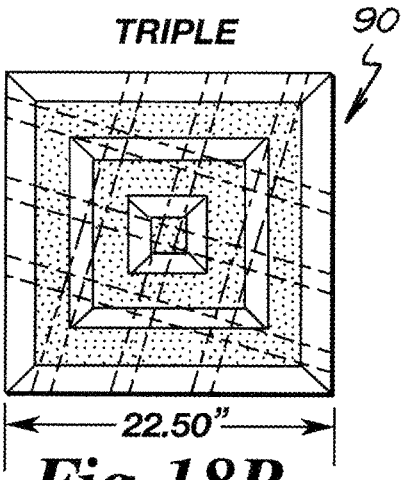
FIG. 18B is a top plan dimensional assembly view of a triple square-shaped thermal break wood support column with mechanical fasteners showing placement of the closed cell foam.
Figure 18C:
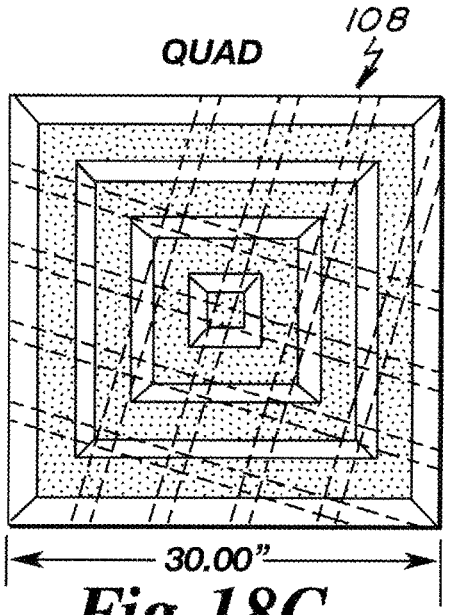
FIG. 18C is a top plan dimensional assembly view of a quad square-shaped thermal break wood support column with mechanical fasteners showing placement of the closed cell foam.
Figure 19:
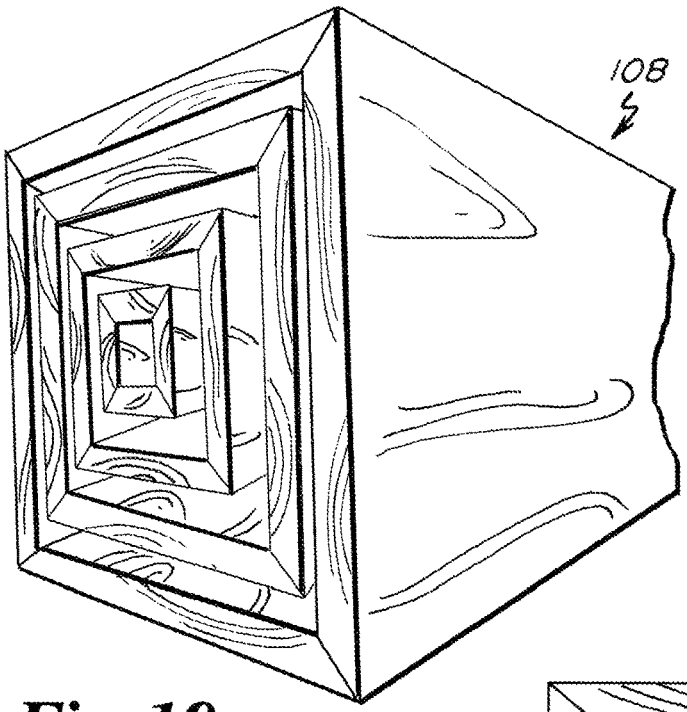
FIG. 19 is a top perspective view of a quad square-shaped thermal break wood support column with mechanical fasteners.
Figure 20:
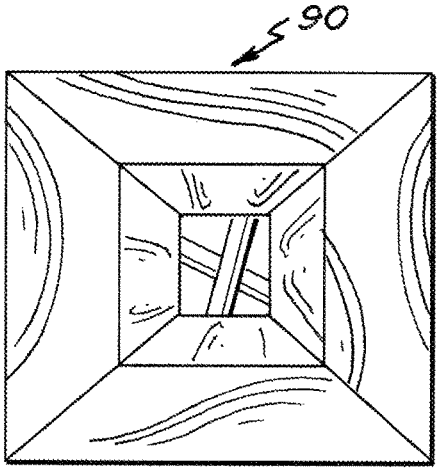
FIG. 20 is an enlarge top plan view looking down into the interior of the quad square-shaped thermal break wood support column with mechanical fasteners.
Figure 21:
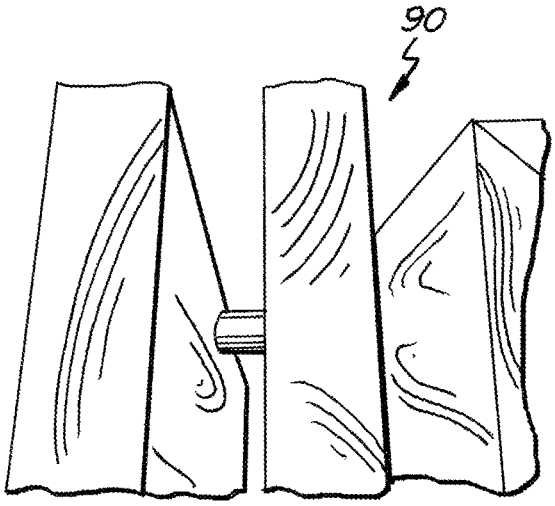
FIG. 21 is another enlarged top plan view looking down into the interior of the triple square-shaped thermal break wood support column with mechanical fasteners.
Figure 22:
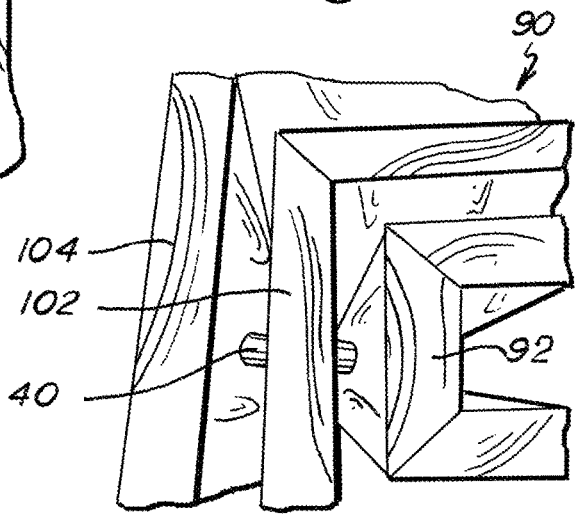
FIG. 22 is another enlarged top plan view looking down into the interior of the triple square-shaped thermal break wood support column with mechanical fasteners.
Figure 24:
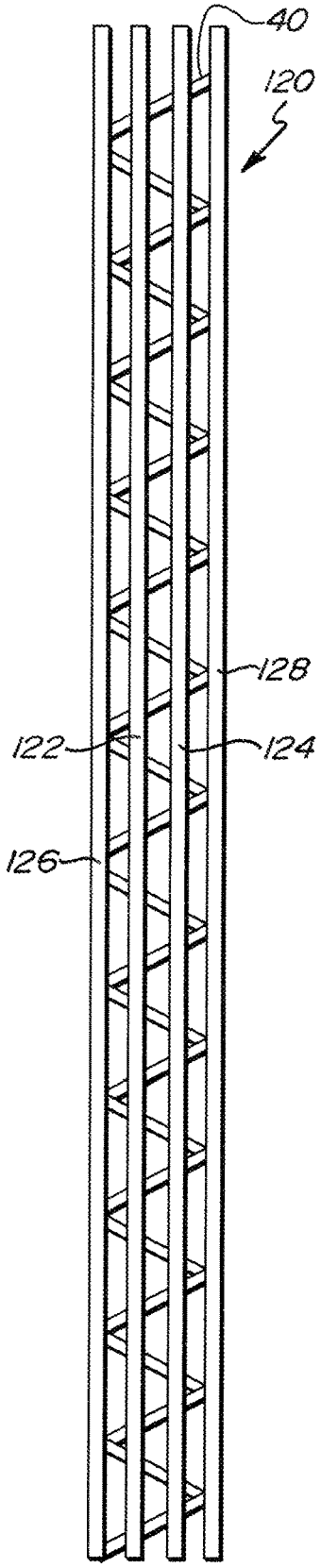
FIG. 24 is a front elevational view of the a quad parallel-shaped thermal break wood support column with mechanical fasteners.
Figure 23:
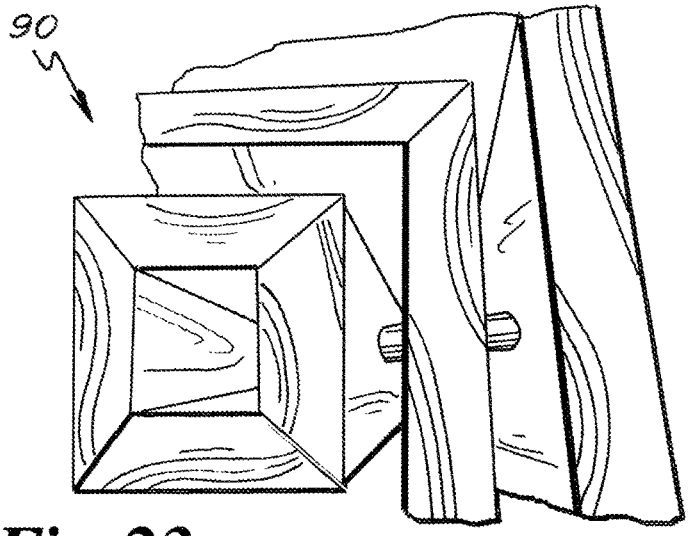
FIG. 23 is another enlarged top plan view looking down into the interior of the triple square-shaped thermal break wood support column with mechanical fasteners.
Figure 25:
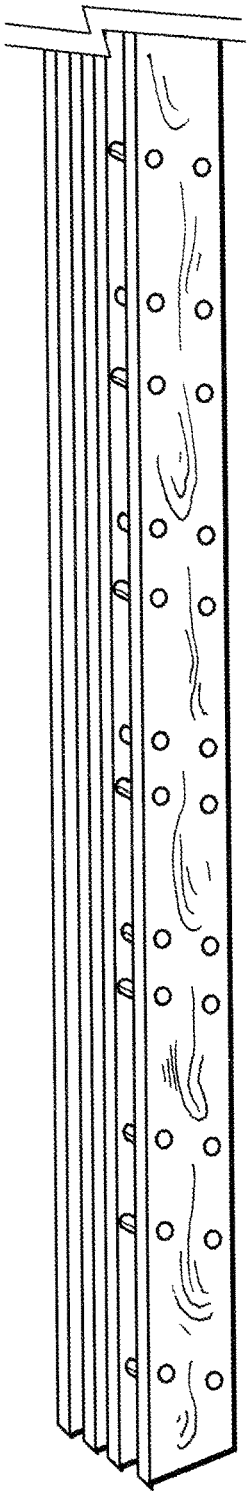
FIG. 25 is a side perspective view of the quad parallel-shaped thermal break wood support column with mechanical fasteners of FIG. 24.
Figure 25A:
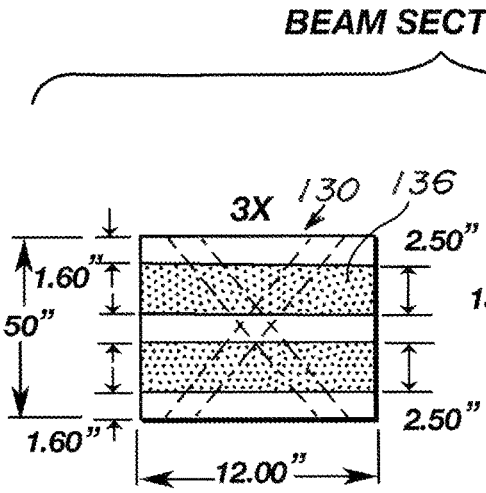
FIG. 25A is a top plan dimensional assembly view with outer dimensions of a triple parallel-shaped thermal break wood support column with mechanical fasteners showing placement of the closed cell foam.
Figure 25B:
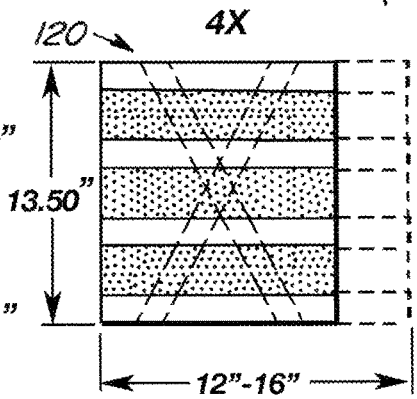
FIG. 25B is a top plan dimensional assembly view with outer dimensions of a quad parallel-shaped thermal break wood support column with mechanical fasteners showing placement of the closed cell foam.
Figure 25C:
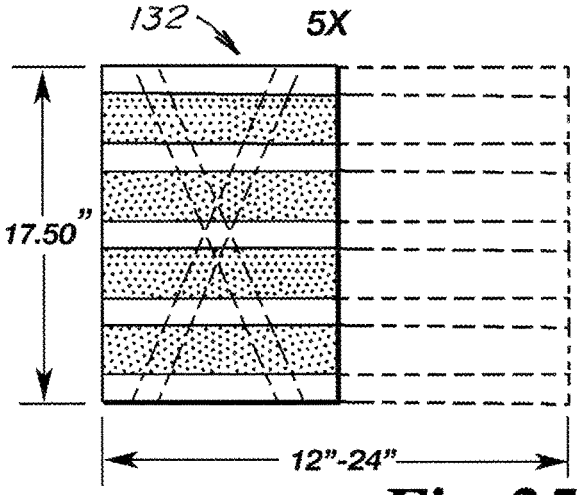
FIG. 25C is a top plan dimensional assembly view with outer dimensions of a five parallel-shaped thermal break wood support column with mechanical fasteners showing placement of the closed cell foam.
Figure 25D:
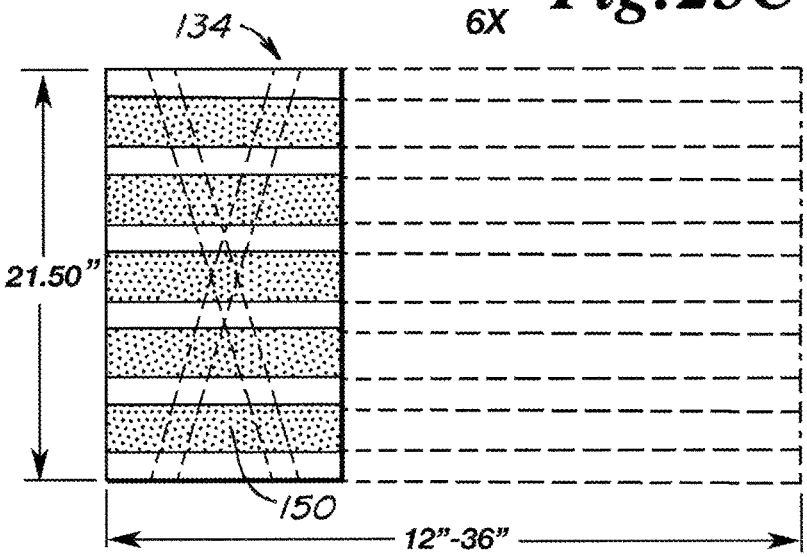
FIG. 25D is a top plan dimensional assembly view with outer dimensions a six parallel-shaped thermal break wood support column with mechanical fasteners showing placement of the closed cell foam.
Figure 30:
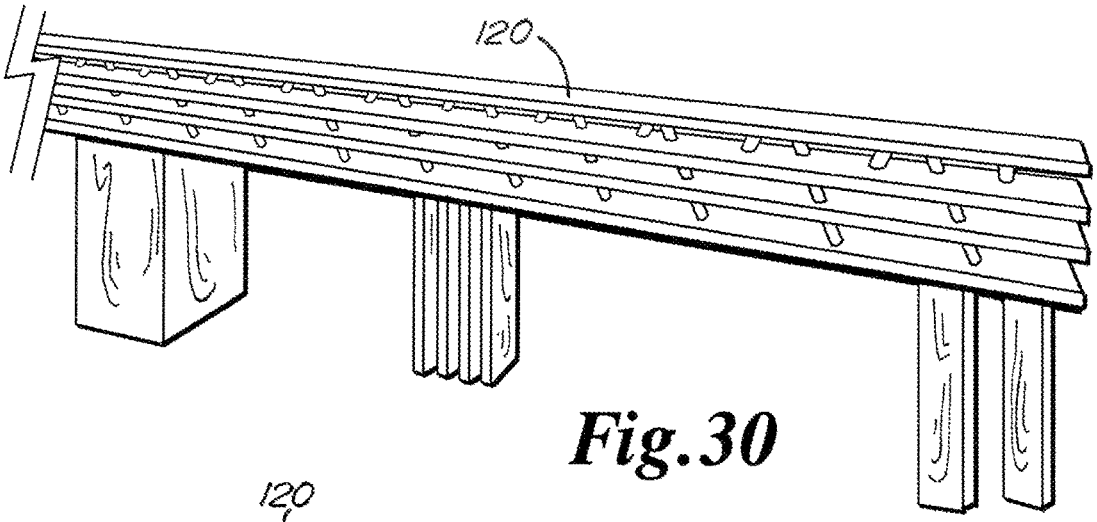
FIG. 30 is a front perspective views of the square-shaped, U-shaped and L-shaped thermal break wood support columns with mechanical fasteners with the quad parallel shaped thermal break wood support column or header being placed on top of the columns of FIG. 29.
Figure 31:
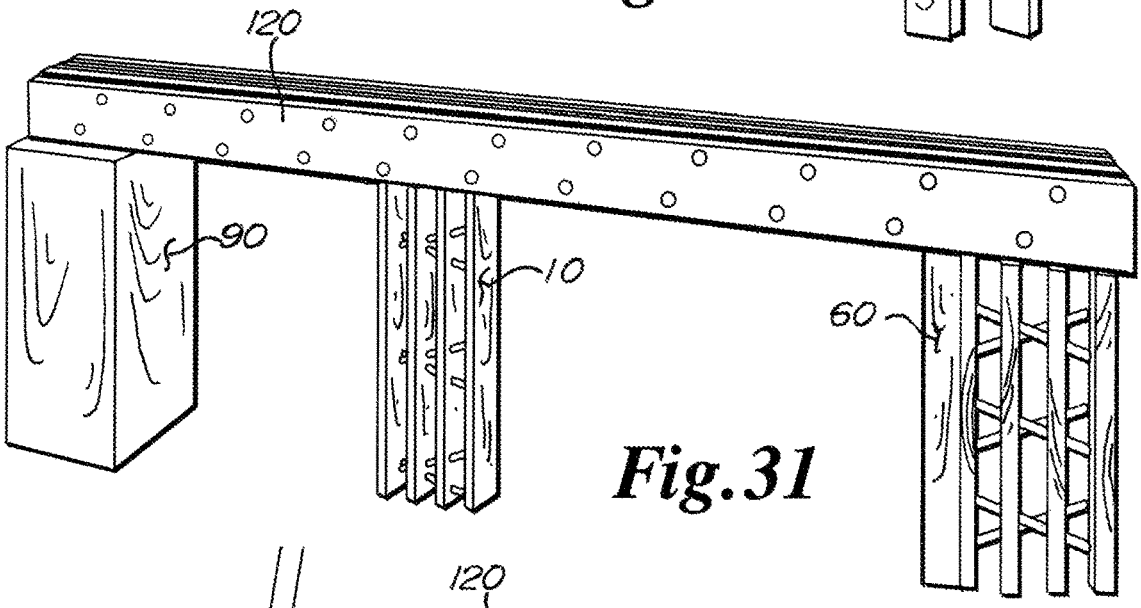
FIG. 31 is a front perspective views of the square-shaped, U-shaped and L-shaped thermal break wood support columns with mechanical fasteners with the quad parallel-shaped thermal break wood support column or header placed on top of the columns of FIG. 29.
Figure 32:
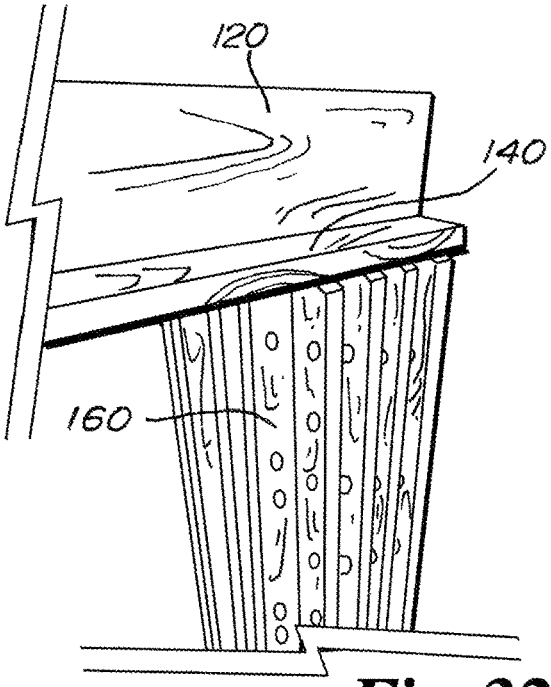
FIG. 32 is a front perspective views of the shaped thermal break wood support columns with mechanical fasteners with a LVL top plate or bottom plate and the quad parallel shaped thermal break wood support column or header placed on top of the columns of FIG. 2.

As previously stated one can size and place tabs and cut outs 28 so support column 60 has only one way to be put together as all square reference surfaces are built-in. Thus this two dimensional all edge-face assembly is also fool proof and easy to form and assemble. Alternatively as shown in FIGS. 9, 12 and 13, the boards side edges can be mitered and glued at their meeting joints.

Mechanical fasters 40 are suitably hard wood dowels 40 approximately 11/16-1½" in diameter to match holes H through the panels. The dowels 40 are run through an abrader device to create a helical outer grooved or fluted outer surface 44 which aids in retaining glue 30 on the outer surface 44 of dowels 40. Panels suitably have angled holes H drilled through them as shown in FIGS. 6 and 7. The holes H in the longitudinal direction have an angles that range from 20°-50° (preferably 38°) and 0°-10° (preferably 8°) in the width direction. Next, wood glue 30 is suitably then coated on the inside surfaces of the angled holes H. The dowels 40 are then pounded into and through holes H after which sawing, sanding or grinding will make the dowels 40 flush with the outer wood section. Mechanical fasteners 40 may also be made of heat resistant plastic. The important consideration is that the dowel 40 must have a high modulus of elasticity. When using 90° angled panels, four staggered and angled mechanical fasteners 40 are used per foot of column 60.

Next the assembled wood column 10 is coated with a liquid wood protection system, discussed above, that is warranted for fire (class A), mould, rot, and insect infestation, including termites.

The final foam section 84 may be of expanded polyurethane, polystyrene or polyisocyanurate. The foam 84 is injected into the open spaces around the mechanical fasteners 40 and between the wood panels. The foam 84 may suitably made by mixing an isocyanate, such as methylene diphenyl diisocyanate (MDI) with a polyol blend, or other suitable rigid foam sheet or there equivalent.

This quad L column design 60 may be built, as shown to be a double L design 76, to be a triple 78, quad 60, five 80 or six 82 L Shape design, illustratively shown in FIGS. 8A, 8*b*, 8C and 8D. These designs are structurally desirable from 25' to as high as 40' tall with little to no deflection. This design will easily hold 45,000 lbs with no wind load deflection. Additional larger sizes should be anticipated.

The following Table 3 shows R values and vertical compression strength ($F_c$) of the double L-shaped (double corner) 10, triple L-shaped design (triple corner) 46 and the quad L-shaped (quad corner) 48 wherein the loads are supported on the ends of the pieces:

TABLE 3

Compression Parallel to Grain Fc and Average R Value

| Type of Wood Member | PSI | Depth in inches | Double Half Box Tmax* | Ultimate Load in Pounds* | Average R Value | Triple Half Box Tmax* | Ultimate Load in Pounds* | Average R Value | Quad Half Box Tmax* | Ultimate Load in Pounds* | Average R Value |
|---|---|---|---|---|---|---|---|---|---|---|---|
| SPF | 1,150 | 1.5 | 40 | 69,000 | 30 | 84 | 144,900 | 40 | 144 | 248,400 | 50 |
| HemFir | 1,450 | 1.5 | 40 | 87,000 | 30 | 84 | 182,700 | 40 | 144 | 313,200 | 50 |
| DougFir | 1,400 | 1.5 | 40 | 84,000 | 30 | 84 | 176,400 | 40 | 144 | 302,400 | 50 |
| SYP #2 | 1,300 | 1.5 | 40 | 78,000 | 30 | 84 | 163,800 | 40 | 144 | 280,800 | 50 |
| MSR2100 | 1,825 | 1.5 | 40 | 109,500 | 30 | 84 | 229,950 | 40 | 144 | 394,200 | 50 |
| LSL | 2,600 | 2 | 40 | 208,000 | 30 | 84 | 436,800 | 40 | 144 | 748,800 | 50 |
| LVL | 3,571 | 2 | 40 | 285,680 | 30 | 84 | 599,928 | 40 | 144 | 1,028,448 | 50 |

*Total lineal inches of wood fiber

Based on known paralell to grain axial loading based on Fc (SPF = spruce, pine fur; HemFir = hemlock fir; DougFir = Douglas fir; SYP #2 = southern yellow pine #2; MSR 2100 = machine stress rated to 2100 psi in bending; LSL = laminated strand lumber; LVL = laminated veneer lumber Referring next to FIGS. 18-23, the triple square design of the thermal break wood support column (or header) 90 with mechanical fasteners 40 of the invention may be seen and is generally used as an exterior wall or interior support buttress 90. The triple square design 90 (box) comprises an inner smallest square section 92 that has four side panels 94, 96, 98 and 100. The panels are held together by an overlapping tab and cut out (box joint) 28 or a mitered joint that are fastened together suitably with glue 30 illustrated in FIGS. 5A. 5B and 5C. Increasing in size are middle square section 102 and outer largest square section 104** all with similarly made panels.

As previously stated one can size and place tabs and cut outs 28 (box joints vs. mitered joints) so support column 90 has only one way to be put together as all square reference surfaces are built-in. Thus this two dimensional all edge-face assembly is also fool proof and easy to form and assemble.

Mechanical fasters 40 are suitably hard wood dowels 40 approximately 11/16-1½ " in diameter to match holes H through the panels. The dowels 40 are run through an abrader device to create a helical outer grooved or fluted outer surface 44 which aids in retaining glue 30 on the outer surface 44 of dowels 40. Panels suitably have angled holes H drilled through them as shown in FIGS. 6 and 7. The holes H in the longitudinal direction have an angles that range from 20°-50° (preferably 38°) and 0°-10° (preferably 8°) in the width direction. Next, wood glue 30 is suitably then coated on the inside surfaces of the angled holes H. The dowels 40 are then pounded into and through holes H after which sawing, sanding or grinding will make the dowels 40 flush with the outer wood section 104. Mechanical fasteners 40 may also be made of heat resistant plastic. The important consideration is that the dowel 40 must have a high modulus of elasticity. When using 90° angled panels, four staggered and angled mechanical fasteners 40 are used per foot of column 60.

Next the assembled wood column 90 is coated with a liquid wood protection system, discussed above, that is warranted for fire (class A), mould, rot, and insect infestation, including termites.

The final foam section 110 may be of expanded polyurethane, polystyrene or polyisocyanurate. The foam 110 is injected into the open spaces around the mechanical fasteners 40 and between the wood panels. The foam 110 may suitably made by mixing an isocyanate, such as methylene diphenyl diisocyanate (MDI) with a polyol blend, or other suitable rigid foam or their equivalent.

This square column design 90 may be built, as shown to be a double square design 106, to be a triple 90 or quad 108 square shape design, illustratively shown in FIGS. 18A, 18*b*, 18C and 18D. These designs are structurally desirable from 25' to as high as 40' tall with little to no deflection. This design will easily hold 45,000 to 90,000 lbs with no wind load deflection. Additional larger sizes should be anticipated to include quintuplet and sextuplet square designs.

The following Table 4 shows R values and vertical compression strength ($F_c$) of the double square (box) 106, triple square (box) 90 and the quad square (box) 108 wherein the loads are supported on the ends of the pieces:

TABLE 4

Compression Parallel to Grain Fc and Average R Value

| Type of Wood Member | PSI | Depth in inches | Double Box Tmax* | Ultimate Load in Pounds* | Average R Value | Triple Box Tmax* | Ultimate Load in Pounds* | Average R Value | Quad Box Tmax* | Ultimate Load in Pounds* | Average R Value |
|---|---|---|---|---|---|---|---|---|---|---|---|
| SPF | 1,150 | 1.5 | 29 | 50,025 | 40 | 152 | 262,200 | 50 | 266 | 458,850 | 60 |
| HemFir | 1,450 | 1.5 | 29 | 63,075 | 40 | 152 | 330,600 | 50 | 266 | 578,550 | 60 |
| DougFir | 1,100 | 1.5 | 29 | 47,850 | 40 | 152 | 250,800 | 50 | 266 | 438,900 | 60 |
| SYP #2 | 1,300 | 1.5 | 29 | 56,550 | 40 | 152 | 296,400 | 50 | 266 | 518,700 | 60 |
| MSR2100 | 1,825 | 1.5 | 29 | 79,388 | 40 | 152 | 416,100 | 50 | 266 | 728,175 | 60 |
| LSL | 2,600 | 2 | 29 | 150,800 | 40 | 152 | 790,400 | 50 | 266 | 1,383,200 | 60 |
| LVL | 3,571 | 2 | 29 | 207,118 | 40 | 152 | 1,085,584 | 50 | 266 | 1,899,772 | 60 |

*Total lineal inches of wood fiber

**Based on known paralell to grain axial loading based on Fc (SPF = spruce, pine fur; HemFir = hemlock fir; DougFir = Douglas fir; SYP #2 = southern yellow pine #2; MSR 2100 = machine stress rated to 2100 psi in bending; LSL = laminated strand lumber; LVL = laminated veneer lumber)

Referring next to FIGS. 24-28, the quad parallel design of the thermal break wood support column (or header) 120 with mechanical fasteners 40 of the invention may be seen and is generally used as an exterior wall support column, interior support column or a header 120. The quad parallel design 120 comprises like inner panel sections 122, 124 and outer panel section 126, 128. Mitered joints or overlapping tab and cut out (box joint) 28 are not needed with this embodiment.

Mechanical fasters 40 are suitably hard wood dowels 40 approximately 11/16-1½" in diameter to match holes H through the panels. The dowels 40 are run through an abrader device to create a helical outer grooved or fluted outer surface 44 which aids in retaining glue 30 on the outer surface 44 of dowels 40. Panels suitably have angled holes H drilled through them as shown in FIGS. 6 and 7. The holes H in the longitudinal direction have an angles that range from 20°-50° and 0°-10° in the width direction. Next, wood glue 30 is suitably then coated on the inside surfaces of the angled holes H. The dowels 40 are then pounded into and through holes H after which sawing, sanding or grinding will make the dowels 40 flush with the outer wood section 126, 128. Mechanical fasteners 40 may also be made of heat resistant plastic. The important consideration is that the dowel 40 must have a high modulus of elasticity. When using parallel panel sections, two staggered and angled mechanical fasteners 40 are used per foot of column 120.

Next the assembled wood column 120 is coated with a liquid wood protection system, discussed above, that is warranted for fire (class A), mould, rot, and insect infestation, including termites.

The final foam section 136 may be of expanded polyurethane, polystyrene or polyisocyanurate. The foam 136 is injected into the open spaces around the mechanical fasteners 40 and between the wood panels. The foam 136 may suitably made by mixing an isocyanate, such as methylene diphenyl diisocyanate (MDI) with a polyol blend, or other suitable rigid foam or their equivalent.

This parallel column design 120 may be built, as shown to be a triple parallel design 130, to be a five parallel design 132 or a six parallel design 136, illustratively shown in FIGS. 25A, 25B, 25C and 25D. These designs are structurally desirable from 25' to as high as 40' tall with little to no deflection. This design will easily hold 45,000 to 90,000 lbs with no wind load deflection. Additional larger sizes should be anticipated.

The following table 5 shows R values and vertical compression strength ($F_c$) of the triple parallel (stacked) 106, quad parallel (stacked) 120, 5 or quintuple parallel (stacked) 132 and the 6 or sextuple parallel (stacked) 134 wherein the loads are supported on the ends of the pieces:

TABLE 5

Compression Parallel to Grain Fc and Average R Value

| Type of Wood Member | PSI | Depth in inches | Triple Stacked Tmax* | Ultimate Load in Pounds* | Average R Value | Quadruple Stacked Tmax* | Ultimate Load in Pounds* | Average R Value |
|---|---|---|---|---|---|---|---|---|
| SPF | 1,150 | 1.5 | 33 | 56,925 | 37 | 44 | 75,900 | 44 |
| HemFir | 1,450 | 1.5 | 33 | 71,775 | 37 | 44 | 95,700 | 44 |
| DougFir | 1,400 | 1.5 | 33 | 69,300 | 37 | 44 | 92,400 | 44 |
| SYP #2 | 1,300 | 1.5 | 33 | 64,350 | 37 | 44 | 85,800 | 44 |
| MSR2100 | 1,825 | 1.5 | 33 | 90,338 | 37 | 44 | 120,450 | 44 |
| LSL | 2,600 | 2 | 33 | 171,600 | 37 | 44 | 228,800 | 44 |
| LVL | 3,571 | 2 | 33 | 235,686 | 37 | 44 | 314,248 | 44 |

| Type of Wood Member | Quintuple Stacked Tmax* | Ultimate Load in Pounds* | Average R Value | Sextuple Stacked Tmax* | Ultimate Load in Pounds* | Average R Value |
|---|---|---|---|---|---|---|
| SPF | 55 | 94,875 | 51 | 66 | 113,850 | 58 |
| HemFir | 55 | 119,625 | 51 | 66 | 143,550 | 58 |
| DougFir | 55 | 115,500 | 51 | 66 | 138,600 | 58 |
| SYP #2 | 55 | 107,250 | 51 | 66 | 128,700 | 58 |
| MSR2100 | 55 | 150,563 | 51 | 66 | 180,675 | 58 |
| LSL | 55 | 286,000 | 51 | 66 | 343,200 | 58 |
| LVL | 55 | 392,810 | 51 | 66 | 471,372 | 58 |

*Total lineal inches of wood fiber

**Based on known paralell to grain axial loading based on Fc (SPF = spruce, pine fur; HemFir = hemlock fir; DougFir = Douglas fir; SYP #2 = southern yellow pine #2; MSR 2100 = machine stress rated to 2100 psi in bending; LSL = laminated strand lumber; LVL = laminated veneer lumber)

Wind loads are also a very important consideration. The U-shaped, L-shaped, square-shaped and parallel-shaped triple and quad designs of the thermal break wood support columns, 46, 48, 78, 60, 90, 108, 130 and 120 respectively, where high wind storms and hurricanes put severe horizontal forces on buildings, stand up nicely to these forces as shown below:

TABLE 6

Compression Parallel to Grain

| Type | PSI | Width | Total Length | Ultimate Load* |
|---|---|---|---|---|
| SPF | 1,150 | 1.5 | 44 | 75,900 |
| HemFir | 1,450 | 1.5 | 44 | 95,700 |
| DougFir | 1,400 | 1.5 | 44 | 92,400 |
| SYP #2 | 1,300 | 1.5 | 44 | 85,800 |
| MSR2100 | 1,825 | 1.5 | 44 | 120,450 |
| LSL | 2,600 | 1.5 | 44 | 171,600 |
| LVL | 3,571 | 1.5 | 44 | 235,686 |

*Provided it does not deflect in the "x" or "y" axis in axial compression loading, in other words, the shape, and the adhesive, and the dowels need to hold it together.

TABLE 7

| Wind Load Chart Maximum Allowable Pressure | | | | | |
|---|---|---|---|---|---|
| | PSF | Width 2 | Height 10 | Height 16 | Height 24 |
| Category 1 | 22.5 | Z | 450 | 720 | 1080 |
| Category 2 | 35 | | 700 | 1120 | 1680 |
| Category 3 | 45 | | 900 | 1440 | 2160 |
| Category 4 | 55 | | 1100 | 1760 | 2640 |
| Category 5 | 65 | | 1300 | 2080 | 3120 |

TABLE 8

| Maximum Load | Maximum Deflection |
|---|---|
| Tstud/MM Triple | |
| 918 | 0.206 |
| 1,815 | 0.535 |
| Tstud/MM Quad | |
| 1,257 | 0.251 |
| 2,963 | 0.755 |
| 3,661 | 1.088 |
| 4,299 | 1.779 |
| 4,976 | 2.631 |
| 6,413 | 4.561 |
| 6,843 | 5.489 |
| 7,303 | 6.823 |

Referring to FIGS. 29-32, U-shaped, L-shaped, square-shaped and parallel-shaped designs of the thermal break wood support columns, 10, 60, 90 and 120 respectively, may be seen as illustratively anticipated to be used. The columns suitable may be in an outer building wall as well as within the interior of the building. Suitably, a LVL top plate or bottom plate 140 is placed between the floor and a header like parallel shaped wood support column 120 before it is securely mounted to the particular column 10, 60 and 90.

Figure 33:
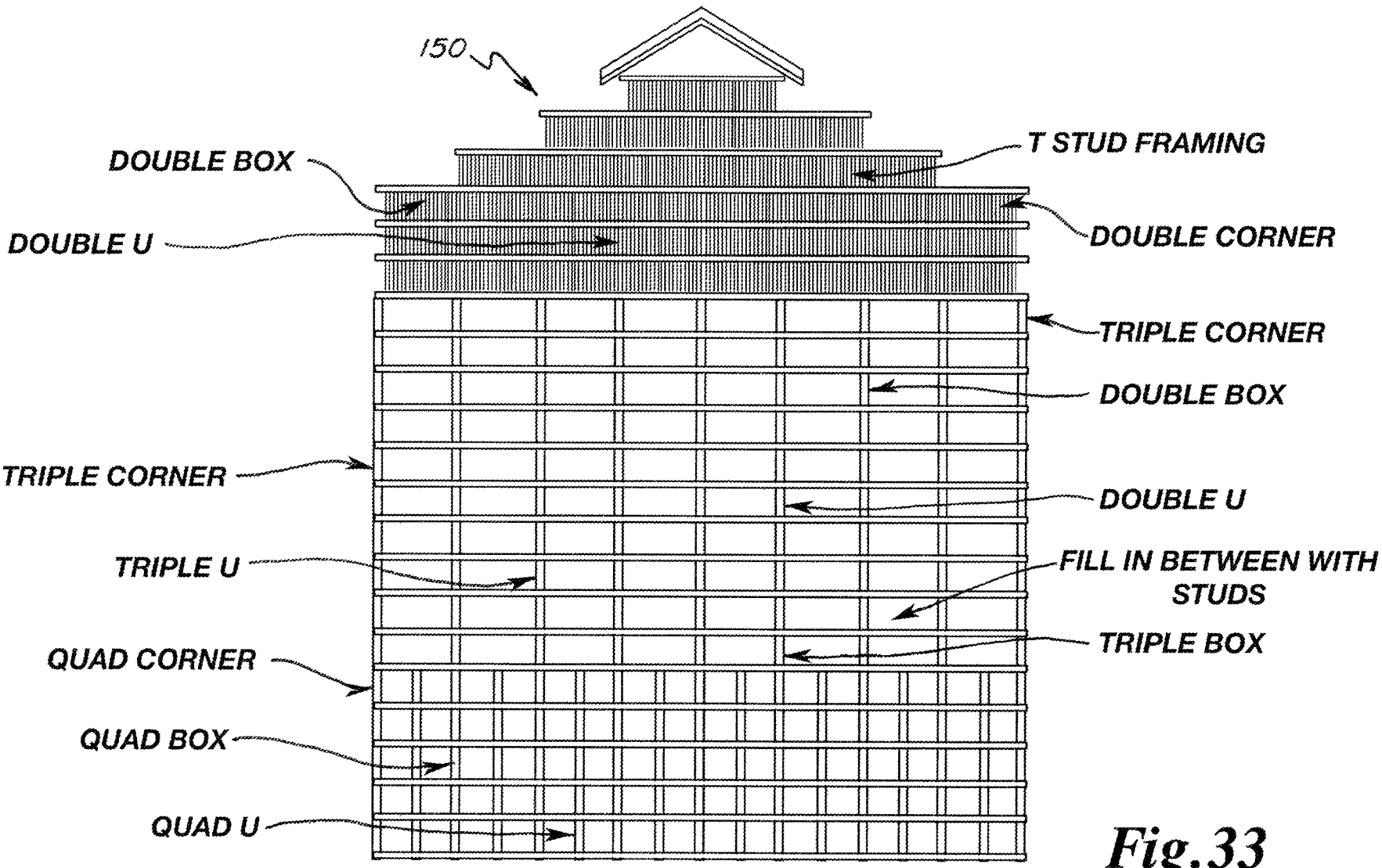
FIG. 33 is a front elevation illustration of a twenty plus story commercial build construction out of the thermal break wood support columns of the invention herein with thermal break wood studs of Applicant's previous two issued U.S. Pat. Nos. 9,677,264 and 9,783,985.

Referring to FIG. 33, an illustrated twenty story building is illustrated and all its vertical supports are various sizes of thermal break wood support columns, 10, 60, 90 and 120 except the top floors may use vertical supports of the type shown in Applicant's previous two issued U.S. Pat. Nos. 9,677,264 and 9,783,985 for thermal break wood studs (Tstuds®).

The above disclosure and accompanying FIGS. are for illustrative purposes only. The true scope of Applicant's invention is described in the following claims.

What is claimed:

1. A thermal break wood and rigid insulation wall support buttress, column or header from 10 feet to 40 feet in length, comprising:

a) at least a first and a second spaced apart right angled aligned wood panel sections wherein the right angled wood panel sections have angled holes therethrough;

b) non-metallic angled mechanical fasteners for passing through the holes and holding the wood panel sections together in a truss angled arrangement rectangular in cross section maintaining the wood panel sections spaced relationship; and c) glue for permanently securely the wood panel sections and the mechanical fasteners together to form the wall support buttress, column or header that is capable of at least 25,000 pounds of vertical load compression.

2. The thermal break wood and rigid insulation wall support buttress, column or header of claim 1, wherein side edges of the wood panel sections are secured together by box joints.

3. The thermal break wood and rigid insulation wall support buttress, column or header of claim 1, wherein side edges of the wood panel sections are secured together by miter joints.

4. The thermal break wood and rigid insulation wall support buttress, column or header of claim 1, wherein a thermal break section of rigid foam insulation is injected between the wood panel sections and around the mechanical fasteners.

5. The thermal break wood and rigid insulation wall support buttress, column or header of claim 1, wherein one of the spaced apart right angled aligned wood panel sections has an opposing parallel aligned wood panel section forming the wall support buttress, column or header that is U-shaped in cross section.

6. The thermal break wood and rigid insulation wall support buttress, column or header of claim 5, wherein the second right angled aligned wood panel section is larger in size from the first right angled aligned wood panel section as to form the wall support buttress, column or header that is U-shaped in cross section.

7. The thermal break wood and rigid insulation wall support buttress, column or header of claim 1, wherein spaced apart right angled aligned wood panel sections form the wall support buttress, column or header that is L-shaped in cross section.

8. The thermal break wood and rigid insulation wall support buttress, column or header of claim 7, wherein the second right angled aligned wood panel section is larger in size from the first right angled aligned wood panel section as to form the wall support buttress, column or header that is L-shaped in cross section.

9. The thermal break wood and rigid insulation wall support buttress, column or header of claim 1, wherein spaced apart right angled aligned wood panel sections have opposing parallel aligned wood panel sections forming the wall support buttress, column or header that is box-shaped in cross section.

10. The thermal break wood and rigid insulation wall support buttress, column or header of claim 9, wherein the second right angled aligned wood panel section is larger in size from the first right angled aligned wood panel section as to form the wall support buttress, column or header that is box-shaped in cross section.

11. A thermal break wood and rigid insulation wall support buttress, column or header from 25 feet to 40 feet in length, comprising:

a) at least three spaced apart parallel aligned wood panel sections wherein the parallel wood panel sections have angled holes therethrough;

b) non-metallic angled mechanical fasteners for passing through the holes and holding the wood panel sections together in a truss angled arrangement rectangular in cross section maintaining the wood panel sections spaced relationship; and c) glue for permanently securing the wood panel sections and the mechanical fasteners together to form the wall support buttress, column or header that is capable of at least 45,000 pounds of vertical load compression.

12. The thermal break wood and rigid insulation wall support buttress, column or header of claim 11, wherein a thermal break section of rigid foam insulation is injected between the wood panel sections and around the mechanical fasteners.

13. A thermal break wood and rigid insulation wall support buttress, column or header from 10 feet to 40 feet in length, comprising:

a) at least two spaced apart right angled aligned wood panel sections and at least one opposing parallel aligned wood panel section forming a first U-shape support buttress, column or header, wherein the wood panel sections have angled holes therethrough;

b) non-metallic angled mechanical fasteners for passing through the holes and holding the wood panel sections together in a truss angled arrangement rectangular in cross section maintaining the wood panel sections spaced relationship; and c) glue for permanently securely the wood panel sections and the mechanical fasteners together to form the wall support buttress, column or header that is U-shaped rectangular in cross section and capable of at least 25,000 pounds of vertical load compression.

14. A thermal break wood and rigid insulation wall support buttress, column or header from 10 feet to 40 feet in length, comprising:

a) at least two spaced apart right angled aligned L-shaped wood panel sections wherein the right angled wood panel sections have angled holes therethrough;

b) non-metallic angled mechanical fasteners for passing through the holes and holding the wood panel sections together in a truss angled arrangement rectangular in cross section maintaining the wood panel sections spaced relationship; and c) glue for permanently securely the wood panel sections and the mechanical fasteners together forming the wall support buttress, column or header that is L-shaped rectangular in cross section and capable of at least 45,000 pounds of vertical load compression.

15. A thermal break wood and rigid insulation wall support buttress, column or header from 10 feet to 40 feet in length, comprising:

a) at least two spaced apart right angled aligned wood panel sections and opposing parallel aligned wood panel sections forming a first and a second box-shaped wood panel sections, wherein the wood panel sections have angled holes therethrough;

b) non-metallic angled mechanical fasteners for passing through the holes and holding the wood panel sections together in a truss angled rectangular in cross section arrangement maintaining the wood panel sections spaced relationship; and c) glue for permanently securely the wood panel sections and the mechanical fasteners together to form the wall support buttress, column or header that is box-shaped and capable of at least 45,000 pounds of vertical load compression.

* * * * *